US008227751B2

(12) United States Patent
Green

(10) Patent No.: US 8,227,751 B2
(45) Date of Patent: Jul. 24, 2012

(54) MASS SPECTROMETER

(75) Inventor: Martin Green, Cheshire (GB)

(73) Assignee: Micromass UK Limited, Manchester (GB)

( * ) Notice: Subject to any disclaimer, the term of this patent is extended or adjusted under 35 U.S.C. 154(b) by 761 days.

(21) Appl. No.: 12/094,318

(22) PCT Filed: Nov. 23, 2006

(86) PCT No.: PCT/GB2006/004385

§ 371 (c)(1), (2), (4) Date: Sep. 25, 2008

(87) PCT Pub. No.: WO2007/060436

PCT Pub. Date: May 31, 2007

(65) Prior Publication Data

US 2009/0114810 A1 May 7, 2009

Related U.S. Application Data

(60) Provisional application No. 60/749,917, filed on Dec. 13, 2005.

(30) Foreign Application Priority Data

Nov. 25, 2005 (GB) ..... 0524042.9

(51) Int. Cl.
*H01J 49/00* (2006.01)
*H01J 49/28* (2006.01)
*H01J 49/30* (2006.01)

(52) U.S. Cl. ..... 250/292; 250/281; 250/282

(58) Field of Classification Search ..... 250/281, 250/282, 290–292

See application file for complete search history.

(56) References Cited

U.S. PATENT DOCUMENTS

| | | | | | |
|---|---|---|---|---|---|
| 3,840,742 | A | * | 10/1974 | Ball | 250/292 |
| 4,208,582 | A | * | 6/1980 | Arnush et al. | 250/291 |
| 4,540,884 | A | * | 9/1985 | Stafford et al. | 250/282 |
| 5,672,870 | A | * | 9/1997 | Flory et al. | 250/292 |
| 5,696,376 | A | * | 12/1997 | Doroshenko et al. | 250/292 |
| 5,783,824 | A | | 7/1998 | Baba et al. | |
| 5,847,386 | A | | 12/1998 | Thomson et al. | |
| 6,177,668 | B1 | | 1/2001 | Hager | |
| 6,323,455 | B1 | * | 11/2001 | Bailey et al. | 250/282 |

(Continued)

FOREIGN PATENT DOCUMENTS

WO 2006075182 7/2006

(Continued)

OTHER PUBLICATIONS

Collings, et al; Observation of Higher Order Quadrupole Excitation Frequencies in a Linear Ion Trap; 2000 J Am Soc Mass Spectrom 2000, 11, 1016-1022.

(Continued)

*Primary Examiner* — Phillip A Johnston
*Assistant Examiner* — Brooke Purinton
(74) *Attorney, Agent, or Firm* — Diederiks & Whitelaw PLC

(57) ABSTRACT

An ion trap mass analyser is disclosed comprising a segmented rod set. Ions are trapped radially within the mass analyser by a radial pseudo-potential well. The ions are also confined axially within a quadratic axial potential well. A supplemental AC voltage or potential is applied to the electrodes comprising the ion trap mass analyser in order to excite parametrically ions within the ion trap.

24 Claims, 13 Drawing Sheets

U.S. PATENT DOCUMENTS

| | | | | |
|---|---|---|---|---|
| 6,897,438 | B2 * | 5/2005 | Soudakov et al. | 250/288 |
| 6,900,433 | B2 * | 5/2005 | Ding | 250/292 |
| 7,034,293 | B2 * | 4/2006 | Wells | 250/292 |
| 7,208,728 | B2 * | 4/2007 | Hashimoto et al. | 250/287 |
| 7,872,229 | B2 * | 1/2011 | Park et al. | 250/292 |
| 2003/0071206 | A1 | 4/2003 | Belov et al. | |
| 2006/0118716 | A1 * | 6/2006 | Michaud et al. | 250/292 |
| 2009/0014637 | A1 * | 1/2009 | Giles et al. | 250/281 |

FOREIGN PATENT DOCUMENTS

| | | |
|---|---|---|
| WO | WO 2006/075182 | 7/2006 |

OTHER PUBLICATIONS

Welling, et al; Ion/molecule reactions, mass spectrometry and optical spectroscopy in a linear ion trap; Int'l Journal of Mass Spectrometry and Ion Processes 172 (1998) 95-114.

Zhao et al., "*Parametric Excitations of Trapped Ions in a Linear rf Ion Trap*", Physical Review A, No. 66, Dec. 2002, pp. 063414-1-063414-7.

* cited by examiner

MASS SPECTROMETER

CROSS REFERENCE TO RELATED APPLICATIONS

This application is the National Stage of International Application No. PCT/GB2006/004385, filed on Nov. 23, 2006, which claims priority to and benefit of U.S. Provisional Patent Application Ser. No. 60/749,917, filed on Dec. 13, 2005 and priority to and benefit of United Kingdom Patent Application No. 0524042.9, filed Nov. 25, 2005. The entire contents of these applications are incorporated herein by reference.

BACKGROUND OF THE INVENTION

The present invention relates to a mass spectrometer and a method of mass spectrometry.

U.S. Pat. No. 5,783,824 discloses a linear ion trap wherein an axial quadratic electrostatic potential is superimposed along the length of the ion trap. Ions are ejected axially from the ion trap by resonance excitation wherein a supplementary excitation axial potential is applied to electrodes of the ion trap. The supplementary axial potential has a frequency which corresponds with the fundamental harmonic frequency of the ions which are desired to be ejected.

The equation of motion for a forced linear harmonic oscillator is given by:

$$\ddot{z} + \frac{q}{m} \cdot k \cdot z = -\frac{q}{m} a\cos(\sigma \cdot t) \tag{1}$$

wherein k is the field constant of the axial quadratic potential (see Eqn. 27), a is the field constant of the modulated axial potential, σ is the frequency of modulation of the axial potential and q is the electron charge multiplied by the number of charges on the ion and m is the molecular mass of the ion.

The exact solution is given below:

$$z(t) = z_1\cos(\omega \cdot t) + \sqrt{(2 \cdot V/k)} \cdot \sin(\omega \cdot t) + \frac{q \cdot k \cdot a}{m(\omega^2 - \sigma^2)}[\cos(\sigma \cdot t) - \cos(\omega \cdot t)] \tag{2}$$

wherein $z_1$ is the initial z coordinate of the ion at t=0 and V is the initial potential of the ion in the z direction at t=0.

Furthermore:

$$\omega = \sqrt{q \cdot k/m} \tag{3}$$

wherein ω is the frequency of simple harmonic motion of the ion in the axial electrostatic field.

The amplitude of oscillations depends upon the driving frequency σ. The amplitude of oscillations has its maximum when the driving frequency matches the fundamental harmonic frequency ω. Under these conditions the system undergoes resonant excitation.

Eqn. 1 describes the situation where the excitation waveform has a linear potential gradient. The field is uniform in space and changes direction or amplitude with time. More generally excitation will be dominated by resonance at the fundamental harmonic frequency when the excitation waveform is of a form which may be expressed by the general series expansion:

$$V(t) = \cos(\sigma t) \cdot \sum_{n=0}^{\infty} C_n z^{(2n+1)} \tag{4}$$

where n is an integer number n=0 . . . ∞, $C_n$ is a coefficient for each order term and σ is the frequency of modulation of the supplementary axial excitation potential.

For example, for dipolar resonance excitation in a Paul ion trap and RF quadrupole devices, it can be seen that the periodic term in Eqn. 1 corresponds to n=0 in Eqn. 4 with $C_0$=a.

According to the arrangement described in U.S. Pat. No. 5,783,824 axial ejection of ions occurs when the frequency of modulation is substantially equal to the fundamental harmonic frequency of ion oscillation. However, this approach has been found to suffer from a relatively low mass resolution given a fixed rate of scanning of the excitation frequency or the depth of the electrostatic potential well.

SUMMARY OF THE INVENTION

It is therefore desired to provide an improved ion trap.

According to an aspect of the present invention there is provided an ion guide or ion trap comprising:

a plurality of electrodes;

AC or RF voltage means arranged and adapted to apply an AC or RF voltage to at least some of the plurality of electrodes in order to confine at least some ions radially within the ion guide or ion trap;

first means arranged and adapted to maintain one or more DC, real or static potential wells along at least a portion of the axial length of the ion guide or ion trap in a first mode of operation; and second means arranged and adapted to apply a supplemental AC voltage or potential to the electrodes in order to excite parametrically at least some ions, in use, within the ion guide or ion trap, wherein the supplemental AC voltage or potential has a frequency σ which is substantially different from the fundamental or resonance frequency ω of ions which are desired to be excited parametrically.

The supplemental AC voltage or potential preferably has a frequency σ equal to 2ω, 0.667ω, 0.5ω, 0.4ω, 0.33ω, 0.286ω, 0.25ω or <0.25ω wherein ω is the fundamental or resonance frequency of ions which are desired to be excited parametrically. The second means is preferably arranged and adapted to excite ions in use in a non-resonant manner. Ions having desired mass to charge ratios are preferably caused to be axially and/or radially ejected from the ion guide or ion trap.

The first means is preferably arranged and adapted to maintain at least 1, 2, 3, 4, 5, 6, 7, 8, 9, 10 or >10 DC, real or static potential wells along at least a portion of the axial length of the ion guide or ion trap.

The first means is preferably arranged and adapted to maintain one or more DC, real or static quadratic potential wells along at least a portion of the axial length of the ion guide or ion trap in a first mode of operation.

According to the preferred embodiment one or more potential wells are preferably maintained along at least 1%, 5%, 10%, 20%, 30%, 40%, 50%, 60%, 70%, 80%, 90%, 95% or 100% of the axial length of the ion guide or ion trap.

The first means is preferably arranged and adapted to maintain one or more DC, real or static potential wells which preferably have a depth selected from the group consisting of:

(i) <10 V; (ii) 10-20 V; (iii) 20-30 V; (iv) 30-40 V; (v) 40-50 V; (vi) 50-60 V; (vii) 60-70 V; (viii) 70-80 V; (ix) 80-90 V; (x) 90-100 V; and (xi) >100 V.

The first means is preferably arranged and adapted to maintain in a first mode of operation one or more potential wells which have a minimum located at a first position along the axial length of the ion guide or ion trap. The ion guide or ion trap preferably has an ion entrance and an ion exit, and the first position is preferably located at a distance L downstream of the ion entrance and/or at a distance L upstream of the ion exit. L is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The first means preferably comprises one or more DC voltage supplies for supplying one or more DC voltages to at least 1%, 5%, 10%, 20%, 30%, 40%, 50%, 60%, 70%, 80%, 90%, 95% or 100% of the electrodes.

The first means is preferably arranged and adapted to provide or maintain an electric field having an electric field strength which varies or increases along at least a portion of the axial length of the ion guide or ion trap.

The first means is preferably arranged and adapted to provide or maintain an electric field having an electric field strength which varies or increases along at least 1%, 5%, 10%, 20%, 30%, 40%, 50%, 60%, 70%, 80%, 90%, 95% or 100% of the axial length of the ion guide or ion trap.

The second means is preferably arranged and adapted to maintain or apply the supplemental AC voltage or potential along at least 1%, 5%, 10%, 20%, 30%, 40%, 50%, 60%, 70%, 80%, 90%, 95% or 100% of the axial length of the ion guide or ion trap.

The second means is preferably arranged and adapted in the first mode of operation to generate an axial electric field which preferably has a substantially linear electric field strength along at least a portion of the axial length of the ion guide or ion trap at any point in time.

The second means is preferably arranged and adapted in the first mode of operation to generate an axial electric field which preferably has a substantially linear electric field strength along at least 1%, 5%, 10%, 20%, 30%, 40%, 50%, 60%, 70%, 80%, 90%, 95% or 100% of the axial length of the ion guide or ion trap at any point in time.

The second means is preferably arranged and adapted in the first mode of operation to generate an axial electric field which preferably has an electric field strength which varies with time.

The second means is preferably arranged and adapted in the first mode of operation to generate an axial electric field which changes direction with time.

The ion guide or ion trap preferably further comprise means arranged and adapted in the first mode of operation to eject at least some ions from the one or more DC, real or static potential wells within the ion guide or ion trap whilst other ions preferably remain substantially trapped within the one or more DC, real or static potential wells. The means may according to one embodiment alter and/or vary and/or scan the amplitude of the supplemental AC voltage or potential. The means may, for example, increase or decrease the amplitude of the supplemental AC voltage or potential.

According to an embodiment the means is preferably arranged and adapted to increase or decrease the amplitude of the supplemental AC voltage or potential in a substantially continuous and/or linear and/or progressive and/or regular manner. According to another embodiment the means is preferably arranged and adapted to increase or decrease the amplitude of the supplemental AC voltage or potential in a substantially non-continuous and/or non-linear and/or non-progressive and/or irregular manner.

The means is preferably arranged to vary the amplitude of the supplemental AC voltage or potential by $x_1$ Volts over a time period of $t_1$ seconds. According to the preferred embodiment $x_1$ is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1-2; (xii) 2-3; (xiii) 3-4; (xiv) 4-5; (xv) 5-6; (xvi) 6-7; (xvii) 7-8; (xviii) 8-9; (xix) 9-10; and (xx) >10. According to the preferred embodiment $t_1$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

The ion guide or ion trap may comprise means arranged and adapted to alter and/or vary and/or scan the frequency of oscillation or modulation of the supplemental AC voltage or potential. The means may, for example, increase or decrease the frequency of oscillation or modulation of the supplemental AC voltage or potential.

The means is preferably arranged and adapted to increase or decrease the frequency of oscillation or modulation of the supplemental AC voltage or potential in a substantially continuous and/or linear and/or progressive and/or regular manner. However, according to another embodiment the means may increase or decrease the frequency of oscillation or modulation of the supplemental AC voltage or potential in a substantially non-continuous and/or non-linear and/or non-progressive and/or irregular manner.

The means is preferably arranged to vary the frequency of oscillation or modulation of the supplemental AC voltage or potential by $f_1$ kHz over a time period of $t_2$ seconds. According to the preferred embodiment $f_1$ is selected from the group consisting of: (i) <5; (ii) 5-10; (iii) 10-15; (iv) 15-20; (v) 20-25; (vi) 25-30; (vi) 30-35; (vii) 35-40; (viii) 40-45; (ix) 45-50; (x) 50-55; (xi) 55-60; (xii) 60-65; (xiii) 65-70; (xiv) 70-75; (xv) 75-80; (xvi) 80-85; (xvii) 85-90; (xviii) 90-95; (xix) 95-100; and (xx) >100. According to the preferred embodiment $t_2$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

The ion guide or ion trap may further comprise means arranged and adapted to alter and/or vary and/or scan the amplitude or depth of the one or more DC, real or static potential wells. The means may, for example, be arranged and adapted to increase or decrease the amplitude or depth of the one or more DC, real or static potential wells.

According to an embodiment the means may be arranged and adapted to increase or decrease the amplitude or depth of the one or more DC, real or static potential wells in a substantially continuous and/or linear and/or progressive and/or regular manner. According to another embodiment the means may be arranged and adapted to increase or decrease the amplitude or depth of the one or more DC, real or static potential wells in a substantially non-continuous and/or non-linear and/or non-progressive and/or irregular manner.

The means is preferably arranged to vary the amplitude of the one or more DC, real or static potential wells by $x_2$ Volts over a time period of $t_3$ seconds. According to the preferred embodiment $x_2$ is selected from the group consisting of: (i) <0.1; (ii) 0.1-0.2; (iii) 0.2-0.3; (iv) 0.3-0.4; (v) 0.4-0.5; (vi) 0.5-0.6; (vii) 0.6-0.7; (viii) 0.7-0.8; (ix) 0.8-0.9; (x) 0.9-1.0; (xi) 1-2; (xii) 2-3; (xiii) 3-4; (xiv) 4-5; (xv) 5-6; (xvi) 6-7; (xvii) 7-8; (xviii) 8-9; (xix) 9-10; and (xx) >10. According to the preferred embodiment $t_3$ is preferably selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

According to an embodiment the ion guide or ion trap may comprise means arranged and adapted to alter and/or vary and/or scan the amplitude of the AC or RF voltage applied to the electrodes in order to confine at least some ions radially within the ion guide or ion trap. The means may be arranged and adapted to increase or decrease the amplitude of the AC or RF voltage. The means is preferably arranged and adapted to increase or decrease the amplitude of the AC or RF voltage in a substantially continuous and/or linear and/or progressive and/or regular manner. According to another embodiment the means may be arranged and adapted to increase or decrease the amplitude of the AC or RF voltage in a substantially non-continuous and/or non-linear and/or non-progressive and/or irregular manner.

According to the preferred embodiment the means is arranged to vary the amplitude of the AC or RF voltage by $x_3$ Volts over a time period of $t_4$ seconds. According to the preferred embodiment $x_3$ is preferably selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. According to the preferred embodiment $t_4$ is preferably selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

The ion guide or ion trap may comprise means arranged and adapted to alter and/or vary and/or scan the frequency of the AC or RF voltage applied to the electrodes in order to confine at least some ions radially within the ion guide or ion trap.

The means is preferably arranged and adapted to increase or decrease the frequency of oscillation or modulation of the AC or RF voltage. The means may be adapted to increase or decrease the frequency of oscillation or modulation of the AC or RF voltage in a substantially continuous and/or linear and/or progressive and/or regular manner. Alternatively, the means may be arranged and adapted to increase or decrease the frequency of oscillation or modulation of the AC or RF voltage in a substantially non-continuous and/or non-linear and/or non-progressive and/or irregular manner.

The means is preferably arranged to vary the frequency of oscillation or modulation of the AC or RF voltage by a frequency $f_2$ over a time period of $t_5$ seconds. According to the preferred embodiment $f_2$ is selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz. According to the preferred embodiment $t_5$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; and (xiii) >20.

The ion guide or ion trap preferably comprises means arranged and adapted to mass selectively eject ions from the ion guide or ion trap.

According to the preferred embodiment the AC or RF voltage means is preferably arranged and adapted to apply an AC or RF voltage to at least 1%, 5%, 10%, 20%, 30%, 40%, 50%, 60%, 70%, 80%, 90%, 95% or 100% of the plurality of electrodes. The AC or RF voltage means is preferably arranged and adapted to supply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. The AC or RF voltage means is preferably arranged and adapted to supply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The ion trap or ion guide preferably comprises a linear ion trap or ion guide.

The ion guide or ion trap preferably comprises a multipole rod set ion guide or ion trap. According to the preferred embodiment the ion guide or ion trap may comprise a quadrupole, hexapole, octapole or higher order multipole rod set. The plurality of electrodes preferably have a cross-section selected from the group consisting of: (i) approximately or substantially circular; (ii) approximately or substantially hyperbolic; (iii) approximately or substantially arcuate or part-circular; (iv) approximately or substantially semi-circular; and (v) approximately or substantially rectangular or square.

A radius inscribed by the multipole rod set ion guide or ion trap is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The ion guide or ion trap is preferably segmented axially or comprises a plurality of axial segments. The ion guide or ion trap preferably comprises x axial segments, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90-100; and (xi) >100. Each axial segment comprises 1, 2, 3, 4, 5, 6, 7, 8, 9, 10, 11, 12, 13, 14, 15, 16, 17, 18, 19, 20 or >20 electrodes.

The axial length of at least 1%, 5%, 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The spacing between at least 1%, 5%, 10%, 20%, 30%, 40%, 50%, 60%, 70%, 80%, 90%, 95% or 100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The ion guide or ion trap preferably comprises a plurality of non-conducting, insulating or ceramic rods, projections or devices. The ion guide or ion trap preferably comprises 1, 2, 3, 4, 5, 6, 7, 8, 9, 10, 11, 12, 13, 14, 15, 16, 17, 18, 19, 20 or >20 rods, projections or devices. The plurality of non-conducting, insulating or ceramic rods, projections or devices preferably further comprise one or more resistive or conducting coatings, layers, electrodes, films or surfaces disposed on, around, adjacent, over or in close proximity to the rods, projections of devices.

According to another embodiment the ion guide or ion trap may comprise a plurality of electrodes having apertures wherein ions are transmitted, in use, through the apertures in the electrodes. Preferably, at least 1%, 5%, 10%, 20%, 30%, 40%, 50%, 60%, 70%, 80%, 90%, 95% or 100% of the electrodes have apertures which are substantially the same size or which have substantially the same area. However, according to another embodiment at least 1%, 5%, 10%, 20%, 30%, 40%, 50%, 60%, 70%, 80%, 90%, 95% or 100% of the electrodes may have apertures which become progressively larger and/or smaller in size or in area in a direction along the axis of the ion guide or ion trap.

Preferably, at least 1%, 5%, 10%, 20%, 30%, 40%, 50%, 60%, 70%, 80%, 90%, 95% or 100% of the electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm.

The ion guide or ion trap may alternatively comprise a plurality of plate or mesh electrodes wherein at least some of the electrodes are arranged generally in the plane in which ions travel in use. The ion guide or ion trap preferably comprises a plurality of plate or mesh electrodes and wherein at least 50%, 55%, 60%, 65%, 70%, 75%, 80%, 85%, 90%, 95% or 100% of the electrodes are arranged generally in the plane in which ions travel in use. The ion guide or ion trap may, for example, comprise at least 2, 3, 4, 5, 6, 7, 8, 9, 10, 11, 12, 13, 14, 15, 16, 17, 18, 19, 20 or >20 plate or mesh electrodes. Adjacent plate or mesh electrodes are preferably supplied with opposite phases of an AC or RF voltage.

The ion guide or ion trap preferably comprises a plurality of axial segments. The ion guide or ion trap preferably comprises at least 5, 10, 15, 20, 25, 30, 35, 40, 45, 50, 55, 60, 65, 70, 75, 80, 85, 90, 95 or 100 axial segments.

The ion guide or ion trap preferably comprises 1, 2, 3, 4, 5, 6, 7, 8, 9, 10 or >10 electrodes. According to another embodiment the ion guide or ion trap preferably comprises at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

The ion guide or ion trap preferably has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The ion guide or ion trap preferably further comprises means arranged and adapted to maintain in a mode of operation the ion guide or ion trap at a pressure selected from the group consisting of: (i) $<1.0\times10^{-1}$ mbar; (ii) $<1.0\times10^{-2}$ mbar; (iii) $<1.0\times10^{-3}$ mbar; (iv) $<1.0\times10^{-4}$ mbar; (v) $<1.0\times10^{-5}$ mbar; (vi) $<1.0\times10^{-6}$ mbar; (vii) $<1.0\times10^{-7}$ mbar; (viii) $<1.0\times10^{-8}$ mbar; (ix) $<1.0\times10^{-9}$ mbar; (x) $<1.0\times10^{-10}$ mbar; (xi) $<1.0\times10^{-11}$ mbar; and (xii) $<1.0\times10^{-12}$ mbar.

According to the preferred embodiment the ion guide or ion trap preferably further comprises means arranged and adapted to maintain in a mode of operation the ion guide or ion trap at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-3}$-$10^{-2}$ mbar; and (x) $10^{-4}$-$10^{-1}$ mbar.

Ions are preferably arranged to be trapped or axially confined within an ion trapping region within the ion guide or ion trap. The ion trapping region preferably has a length l, wherein 1 is selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix)160-180 mm; (x) 180-200 mm; and (xi) >200 mm.

In a mode of operation at least some ions are preferably axially and/or radially ejected from the ion guide or ion trap whilst at least some other ions preferably remain trapped within the ion guide or ion trap prior to the second means applying a supplemental AC voltage or potential to the electrodes in order to excite parametrically at least some ions.

In a mode of operation at least some ions preferably escape from the ion guide or ion trap as ions enter the ion guide or ion trap and wherein at least some other ions are not able to escape from the ion guide or ion trap and hence become trapped within the ion guide or ion trap.

In a mode of operation ions are preferably trapped but are not substantially fragmented within the ion guide or ion trap.

The ion guide or ion trap preferably further comprises means arranged and adapted to collisionally cool or substantially thermalise ions within the ion guide or ion trap in a mode of operation. According to an embodiment the means may be arranged and adapted to collisionally cool or thermalise ions within the ion guide or ion trap prior to and/or subsequent to at least some ions being excited parametrically and/or ejected from the ion guide or ion trap.

The ion guide or ion trap preferably further comprises fragmentation means arranged and adapted to substantially fragment ions within the ion guide or ion trap in a mode of operation. The fragmentation means may be arranged and adapted to fragment ions by Collisional Induced Dissociation, Surface Induced Dissociation, Electron Capture Dissociation or Electron Transfer Dissociation in the mode of operation.

The ion guide or ion trap preferably further comprises means arranged and adapted to excite parametrically at least some ions at substantially the same time as resonantly exciting at least some ions.

In a second mode of operation ions may be resonantly and/or mass selectively ejected axially and/or radially from the ion guide or ion trap. In the second mode of operation to the frequency and/or amplitude of an AC or RF voltage applied to the electrodes may be adjusted in order to eject ions by mass selective instability.

The ion guide or ion trap preferably further comprises means arranged and adapted in a second mode of operation to superimpose an AC or RF supplementary waveform or voltage to the plurality of electrodes in order to eject ions by resonance ejection.

The ion guide or ion trap may comprise means arranged and adapted in the second mode of operation to apply a DC bias voltage to the plurality of electrodes in order to eject ions.

In a further mode of operation the ion guide or ion trap may be arranged to transmit ions or store ions without the ions being mass selectively and/or non-resonantly ejected from the ion guide or ion trap.

In a further mode of operation the ion guide or ion trap may be arranged to mass filter or mass analyse ions.

In a further mode of operation the ion guide or ion trap is preferably arranged to act as a collision, fragmentation or reaction device without ions being mass selectively and/or non-resonantly ejected from the ion guide or ion trap.

The ion guide or ion trap may further comprise means arranged and adapted to store or trap ions within the ion guide or ion trap in a mode of operation at one or more positions which are closest to the entrance and/or centre and/or exit of the ion guide or ion trap.

The ion guide or ion trap may further comprise means arranged and adapted to trap ions within the ion guide or ion trap in a mode of operation and to progressively move the ions towards the entrance and/or centre and/or exit of the ion guide or ion trap.

The ion guide or ion trap may further comprise means arranged and adapted to apply one or more transient DC voltages or one or more transient DC voltage waveforms to the electrodes initially at a first axial position. The one or more transient DC voltages or one or more transient DC voltage waveforms are then preferably subsequently provided at second, then third different axial positions along the ion guide or ion trap.

According to an embodiment the ion guide or ion trap may further comprise means arranged and adapted to apply, move or translate one or more transient DC voltages or one or more transient DC voltage waveforms from one end of the ion guide or ion trap to another end of the ion guide or ion trap in order to urge ions along at least a portion of the axial length of the ion guide or ion trap.

The one or more transient DC voltages preferably create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage waveforms preferably comprise a repeating waveform or square wave.

The ion guide or ion trap preferably further comprises means arranged to apply one or more trapping electrostatic or DC potentials at a first end and/or a second end of the ion guide or ion trap.

The ion guide or ion trap preferably further comprises means arranged to apply one or more trapping electrostatic potentials along the axial length of the ion guide or ion trap.

According to another aspect of the present invention there is provided a mass spectrometer comprising an ion guide or an ion trap as discussed above.

The mass spectrometer preferably further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source preferably comprises a continuous or pulsed ion source.

The mass spectrometer preferably further comprises one or more further ion guides or ion traps arranged upstream and/or downstream of the ion guide or ion trap. The one or more further ion guides or ion traps may be arranged and adapted to collisionally cool or to substantially thermalise ions within the one or more further ion guides or ion traps. The one or more further ion guides or ion traps may be arranged and adapted to collisionally cool or to substantially thermalise ions within the one or more further ion guides or ion traps prior to and/or subsequent to ions being introduced into the ion guide or ion trap.

The mass spectrometer preferably further comprises means arranged and adapted to introduce, axially inject or eject, radially inject or eject, transmit or pulse ions from the one or more further ion guides or ion traps into the preferred ion guide or ion trap.

The mass spectrometer preferably further comprises means arranged and adapted to substantially fragment ions within the one or more further ion guides or ion traps.

The one or more further ion guides or ion traps are preferably selected from the group consisting of:

(i) a multipole rod set or a segmented multipole rod set ion trap or ion guide comprising a quadrupole rod set, a hexapole rod set, an octapole rod set or a rod set comprising more than eight rods;

(ii) an ion tunnel or ion funnel ion trap or ion guide comprising a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area;

(iii) a stack or array of planar, plate or mesh electrodes, wherein the stack or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes and wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use; and (iv) an ion trap or ion guide comprising a plurality of groups of electrodes arranged axially along the length of the ion trap or ion guide, wherein each group of electrodes comprises: (a) a first and a second electrode and means for applying a DC voltage or potential to the first and second electrodes in order to confine ions in a first radial direction within the ion guide; and (b) a third and a fourth electrode and means for applying an AC or RF voltage to the third and fourth electrodes in order to confine ions in a second radial direction within the ion guide.

The one or more further ion traps or ion guides preferably comprise an ion tunnel or ion funnel ion trap or ion guide wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm.

The one or more further ion traps or ion guides preferably further comprise first AC or RF voltage means arranged and adapted to apply an AC or RF voltage to at least 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the one or more further ion traps or ion guides in order to confine ions radially within the one or more further ion traps or ion guides.

The first AC or RF voltage means is preferably arranged and adapted to apply an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The first AC or RF voltage means is preferably arranged and adapted to apply an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The one or more further ion traps or ion guides are preferably arranged and adapted to receive a beam or group of ions and to convert or partition the beam or group of ions such that a plurality or at least 1, 2, 3, 4, 5, 6, 7, 8, 9, 10, 11, 12, 13, 14, 15, 16, 17, 18, 19 or 20 separate packets of ions are confined and/or isolated in the one or more further ion traps or ion guides at any particular time. Each packet of ions is preferably separately confined and/or isolated in a separate axial potential well formed within the one or more further ion traps or ion guides.

The mass spectrometer preferably further comprises means arranged and adapted to urge at least some ions upstream and/or downstream through or along at least 5%, 10%, 15%, 20%, 25%, 30%, 35%, 40%, 45%, 50%, 55%, 60%, 65%, 70%, 75%, 80%, 85%, 90%, 95% or 100% of the axial length of the one or more further ion traps or ion guides in a mode of operation.

The mass spectrometer preferably further comprises first transient DC voltage means arranged and adapted to apply one or more transient DC voltages or potentials or one or more transient DC voltage or potential waveforms to the electrodes forming the one or more further ion traps or ion guides in order to urge at least some ions upstream and/or downstream along at least 5%, 10%, 15%, 20%, 25%, 30%, 35%, 40%, 45%, 50%, 55%, 60%, 65%, 70%, 75%, 80%, 85%, 90%, 95% or 100% of the axial length of the one or more further ion traps or ion guides.

The mass spectrometer preferably further comprises AC or RF voltage means arranged and adapted to apply two or more phase-shifted AC or RF voltages to electrodes forming the one or more further ion traps or ion guides in order to urge at least some ions upstream and/or downstream along at least 5%, 10%, 15%, 20%, 25%, 30%, 35%, 40%, 45%, 50%, 55%, 60%, 65%, 70%, 75%, 80%, 85%, 90%, 95% or 100% of the axial length of the one or more further ion traps or ion guides.

The mass spectrometer preferably further comprises means arranged and adapted to introduce, axially inject or eject, radially inject or eject, transmit or pulse ions into the ion guide or ion trap.

The mass spectrometer preferably further comprises a mass filter or mass analyser arranged upstream and/or downstream of the ion guide or ion trap.

The mass filter or mass analyser is preferably selected from the group consisting of: (i) a quadrupole rod set mass filter or mass analyser; (ii) a Time of Flight mass filter or mass analyser; (iii) a Wein filter; and (iv) a magnetic sector mass filter or analyser.

In a mode of operation the mass filter or mass analyser may be operated in a substantially non-resolving or ion guiding mode of operation. Alternatively, the mass filter or mass analyser may be scanned or a mass to charge ratio transmission window of the mass filter or mass analyser may be varied with time.

In a mode of operation the mass filter or mass analyser is preferably scanned or a mass to charge ratio transmission window of the mass filter or mass analyser is varied with time in synchronism with the operation of the ion guide or ion trap or with the mass to charge ratio of ions emerging from and/or being transmitted to the ion guide or ion trap.

The mass spectrometer preferably further comprises one or more ion detectors arranged upstream and/or downstream of the ion guide or ion trap.

The mass spectrometer preferably further comprises a mass analyser arranged downstream and/or upstream of the ion guide or ion trap. The mass analyser is preferably selected from the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Fourier Transform mass spectrometer; and (xiii) a quadrupole rod set mass filter or mass analyser.

According to another aspect of the present invention there is provided a method of guiding or trapping ions comprising:

providing an ion guide or ion trap comprising a plurality of electrodes;

applying an AC or RF voltage to at least some of the plurality of electrodes in order to confine at least some ions radially within the ion guide or ion trap;

maintaining one or more DC, real or static potential wells along at least a portion of the axial length of the ion guide or ion trap in a first mode of operation; and applying a supplemental AC voltage or potential to the electrodes in order to excite parametrically ions within the ion guide or ion trap, wherein the supplemental AC voltage or potential has a frequency $\sigma$ which is substantially different from the fundamental or resonance frequency $\omega$ of ions within the ion guide or ion trap which are desired to be excited parametrically.

According to another aspect of the present invention there is provided a method of mass spectrometry comprising the method as described above.

Less preferred embodiments of the present invention are also contemplated wherein the fundamental or resonance frequency $\omega$ of ions may be changed or modified by changing the parameter k as described by Eqns. 3 and 8. According to an embodiment a supplemental AC voltage is applied to the electrodes of the ion trap or ion guide and the frequency and amplitude of the supplemental AC voltage are preferably kept substantially constant. However, the depth or amplitude of the real, DC or static potential well is preferably varied, altered, modified or scanned. This will preferably have the effect of modifying or altering the fundamental or resonance frequency of ions. Prior to altering the depth or amplitude of the real, DC or static potential well certain ions will not be resonantly excited by the application of the supplemental AC voltage. However, as the depth or amplitude of the real, DC or static potential well is varied, altered, modified or scanned then the resonance frequency of the ions will change and as a result some ions may then be resonantly excited by the application of the supplemental AC voltage.

According to another aspect of the present invention there is provided an ion guide or ion trap comprising:

a plurality of electrodes;

AC or RF voltage means arranged and adapted to apply an AC or RF voltage to at least some of the plurality of electrodes in order to confine at least some ions radially within the ion guide or ion trap;

first means arranged and adapted to maintain one or more DC, real or static potential wells along at least a portion of the axial length of the ion guide or ion trap in a first mode of operation; and second means arranged and adapted to apply a supplemental AC voltage or potential to the electrodes in order to parametrically excite at least some ions, in use, within the ion guide or ion trap.

The ion guide or ion trap preferably further comprises means arranged and adapted to alter and/or vary and/or scan the amplitude or depth of the one or more DC, real or static potential wells.

According to another aspect of the present invention there is provided a method of guiding or trapping ions comprising:

providing an ion guide or ion trap comprising a plurality of electrodes;

applying an AC or RF voltage to at least some of the plurality of electrodes in order to confine at least some ions radially within the ion guide or ion trap;

maintaining one or more DC, real or static potential wells along at least a portion of the axial length of the ion guide or ion trap in a first mode of operation; and applying a supplemental AC voltage or potential to the electrodes in order to parametrically excite ions within the ion guide or ion trap.

The method preferably further comprises altering and/or varying and/or scanning the amplitude or depth of the one or more DC, real or static potential wells.

The preferred embodiment relates to a linear RF ion guide or ion trap wherein ions are confined along the axis of the ion guide or ion trap. An electrostatic axial potential gradient is preferably disposed or superimposed about a point along the axis of the ion guide or ion trap so that the electrostatic field created by the potential gradient exerts a force on ions displaced from the point such as to accelerate ions back towards the point.

An additional alternating axial electric field or supplemental AC voltage is preferably applied to the electrodes in such a way as to facilitate parametric excitation or instability and corresponding axial ejection of ions from the ion guide or ion trap. Mass selective axial ejection is preferably achieved by altering the frequency of modulation of the parametric excitation waveform or supplemental AC voltage. Alternatively mass selective axial ejection may be accomplished by altering the depth of the electrostatic axial well at a fixed frequency of modulation of the parametric excitation waveform. This results in an increase in the amplitude of axial oscillations at a characteristic frequency of parametric excitation for each mass to charge ratio value. Ions are preferably sequentially ejected and are preferably detected. A mass spectrum is then preferably produced.

The additional alternating axial electric field or supplemental AC voltage is such that the axial potential gradient is disposed about a point on that axis. The electrostatic field created by the potential gradient preferably exerts a force on ions displaced from the point such as to accelerate ions towards the point at the maxima of modulation and such as to accelerate ions away from the point at the minima of modulation.

An oscillating system is said to undergo parametric excitation when one of its characteristic parameters is modulated. According to the preferred embodiment the characteristic harmonic frequency of oscillation of ions is modulated by the application of a secondary periodic potential gradient. The secondary periodic potential gradient preferably has a form which may be expressed by the general series expansion:

$$V(t) = \cos(\sigma t) \cdot \sum_{n=0}^{\infty} C_n z^{(2n+2)} \tag{5}$$

wherein n is an integer number n=0 . . . ∞, $C_n$ are coefficients for each order term and σ is the frequency of modulation of the additional axial excitation potential.

According to the preferred embodiment the electrostatic axial field is substantially linear i.e. the voltage or potential distribution along the axis of the ion guide or ion trap is approximately quadratic. The additional axial superimposed alternating field is also preferably substantially linear i.e. the alternating voltage or potential distribution along the axis is also preferably approximately quadratic. The system is preferably arranged to undergo parametric quadrupolar excitation.

Mass selective axial ejection using parametric quadrupolar excitation has several differences over the method of resonance excitation disclosed in U.S. Pat. No. 5,783,824.

Fundamentally parametric excitation is an instability phenomenon and is not a resonance phenomenon. At low amplitude of excitation modulation, parametric excitation occurs when the conditions relating ω (the fundamental frequency of ion oscillation in the axial electrostatic well) and σ (the frequency of modulation of the additional axial excitation potential) satisfy the relationship:

$$\sigma_n = \frac{2\omega}{n} \tag{6}$$

where n=1, 2 . . . .

Energy is absorbed by the oscillating ions most efficiently when n=1 i.e. when:

$$\sigma = 2\omega \tag{7}$$

This is in contrast to resonance excitation wherein energy is absorbed by the oscillating ions most efficiently when σ=ω. No resonance condition exists under the condition described by Eqn. 7.

The relationship in Eqn. 7 illustrates an important advantage of parametric excitation for mass selective ejection over the conventional approach of resonance excitation. Ions may be axially ejected from the preferred ion guide or ion trap by application of an excitation potential modulated at twice the frequency of the characteristic harmonic oscillation frequency or resonance frequency for a particular mass to charge ratio value. This leads to an improvement in mass resolution for a constant rate of change of the frequency of modulation of the additional or supplemental axial excitation potential during an analytical scan.

From Eqn. 3 the characteristic frequency of oscillation ω in a quadratic electrostatic well is:

$$\omega=\sqrt{q\cdot k/m} \tag{8}$$

Therefore:

$$m=qk/\omega^2 \tag{9}$$

By differentiation:

$$\delta m = \frac{-2qk}{\omega^3}\cdot\delta\omega \tag{10}$$

Substituting:

$$qk=m\omega^2 \tag{11}$$

yields:

$$\delta m = \frac{-2m\omega^2}{\omega^3}\cdot\delta\omega \tag{12}$$

The relationship between mass resolution and frequency resolution is given by:

$$\frac{m}{\delta m} = -\frac{\omega}{2\delta\omega} \tag{13}$$

Defining ω as:

$$\omega=\omega_0+\Delta\omega \tag{14}$$

wherein $\omega_0$ is the theoretical fundamental frequency of ion oscillation in an electrostatic well and Δω is the spread in the fundamental frequency of ion oscillation in the electrostatic well due to factors including field imperfections, space charge effects and initial ion velocities.

If ion ejection occurs at a value of the frequency of modulation of a supplemental axial excitation potential σ where:

$$\sigma=\omega \tag{15}$$

Then:

$$\frac{m}{\partial m} = \frac{\sigma}{2\delta\omega} = \frac{\omega}{2\delta\omega} \tag{16}$$

However, if ion ejection occurs at a value of the frequency of modulation of the additional axial excitation potential σ where:

$$\sigma=2\omega \tag{17}$$

Then:

$$\frac{m}{\partial m} = \frac{\sigma}{2\delta\omega} = \frac{2\omega}{2\delta\omega} \tag{18}$$

From a comparison of Eqns. 16 and 18 it is apparent that the mass resolution for ion ejection when ions are parametrically excitated at twice the resonance frequency of the ions is twice that obtained if the ions were resonantly ejected from the ion trap. It is therefore apparent that the ion trap mass analyzer according to the preferred embodiment has a substantially improved mass resolution compared with a conventional mass analyzer.

In addition to the condition described by Eqn. 6, instability can occur in the ranges of frequencies lying on either side of $\sigma_n$. These ranges become wider as the amplitude of modulation of the additional or supplemental axial excitation potential is increased. These additional areas of instability may be exploited to allow different modes of mass selective ejection operation at different modulation frequencies and amplitudes.

Another important difference between parametric excitation and resonance excitation is related to the dependence of growth of energy on the energy already stored in the system. For resonance excitation the increment in energy during one period of oscillation is proportional to the amplitude of oscillation and therefore proportional to the square root of the energy in the system. For parametric excitation the increment in energy is directly proportional to energy in the system. Energy losses caused by damping due to the presence of buffer gas are also proportional to the energy stored in the system. In the case of resonance excitation these energy losses restrict the growth of the amplitude as they grow with the energy of the oscillations faster than the energy imparted by the driving force. For parametric resonance both the energy losses from collisional damping and the increment in energy from the driving force are proportional to the energy of the oscillations and so their ratio does not depend on amplitude. Therefore, parametric instability can only occur when a threshold is exceeded, that is, when the increment in energy during a period, caused by the modulated driving force, exceeds the amount of energy dissipated due to collisional damping during the same time period. However, once the threshold is exceeded damping effects will not restrict the growth in amplitude of oscillation.

The energy loss due to collisional damping is a function of the mobility of the ions. The mobility is a function of the cross sectional area of the ion, the damping gas number density, the charge of the ion, the masses of the ion and the gas molecule, and the temperature. Hence, under these conditions, the equation of motion is also dependent on the mobility of the ions. Hence, the conditions for ejection of ions will also be dependent on the mobility of the ions.

New equations of motion and stability diagrams may be generated for different damping conditions.

BRIEF DESCRIPTION OF THE DRAWINGS

Various embodiments of the present preferred embodiment will now be described, by way of example only, and with reference to the accompanying drawings in which.

DETAILED DESCRIPTION OF THE PREFERRED EMBODIMENTS

A preferred embodiment of the present invention will now be described with reference to FIG. 1. According to the preferred embodiment of the present invention a quadrupole rod set ion guide 1 is provided comprising electrodes 2*a*,2*b* having arcuate or hyperbolic surfaces. The electrodes 2*a*,2*b* are preferably split or axially divided into a plurality of axial segments. The number of axial segments is preferably arranged such that when electrostatic potentials are applied to each of the axial segments an electrostatic potential profile can be obtained which relaxes as close as possible to a quadratic function.

Figure 1:
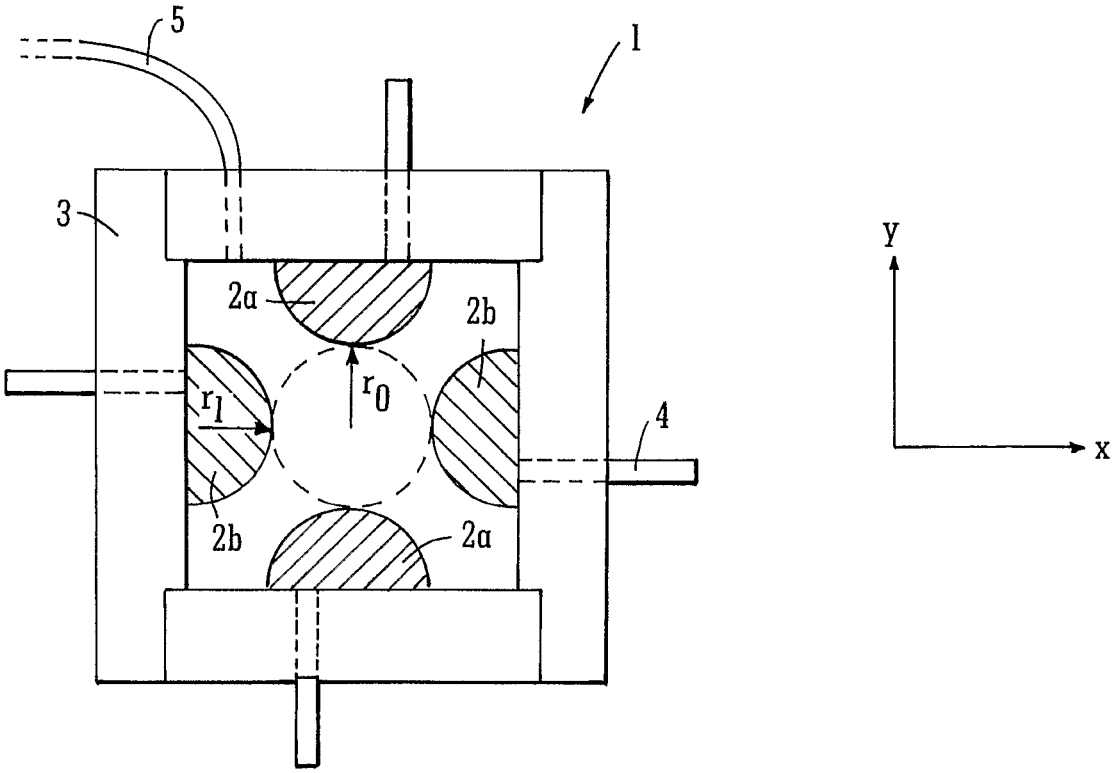
FIG. 1 shows a schematic diagram of an ion trap according to a preferred embodiment in the x,y plane.

FIG. 1 shows two electrode pairs 2*a*,2*b* viewed along the z (axial) direction. The electrodes 2*a*,2*b* have a semi-circular cross-section and are mounted on a non-conductive or insulating substrate or block 3. The electrically insulating substrate or block 3 serves to ensure that the axial segments are positioned correctly with respect to each other and with respect to the other rods. Each axial rod segment is preferably 3 mm long and the axial segments are preferably spaced 1 mm apart. Electrical connections to the electrodes are preferably made via pins 4 which preferably pass through the insulating substrate or block 3. Voltages are preferably applied to each rod segment via the pins 4.

The radius $r_0$ of the inscribed circle made by the four rods 2*a*,2*b* is preferably 5.32 mm. The radius of the rods r1 is preferably 6 mm. According to the preferred embodiment each rod preferably comprises 46 separate axial segments. A 0.5 mm thick plate is preferably provided at the entrance and exit of the ion guide or ion trap 1. The plates arranged at the entrance and exit preferably have a 2 mm diameter hole positioned along the central axis. A gas inlet line 5 preferably passes through one of the insulting blocks 3 and allows a buffer gas such as Helium to be introduced into the ion trap 1 or ion guide.

Figure 2:
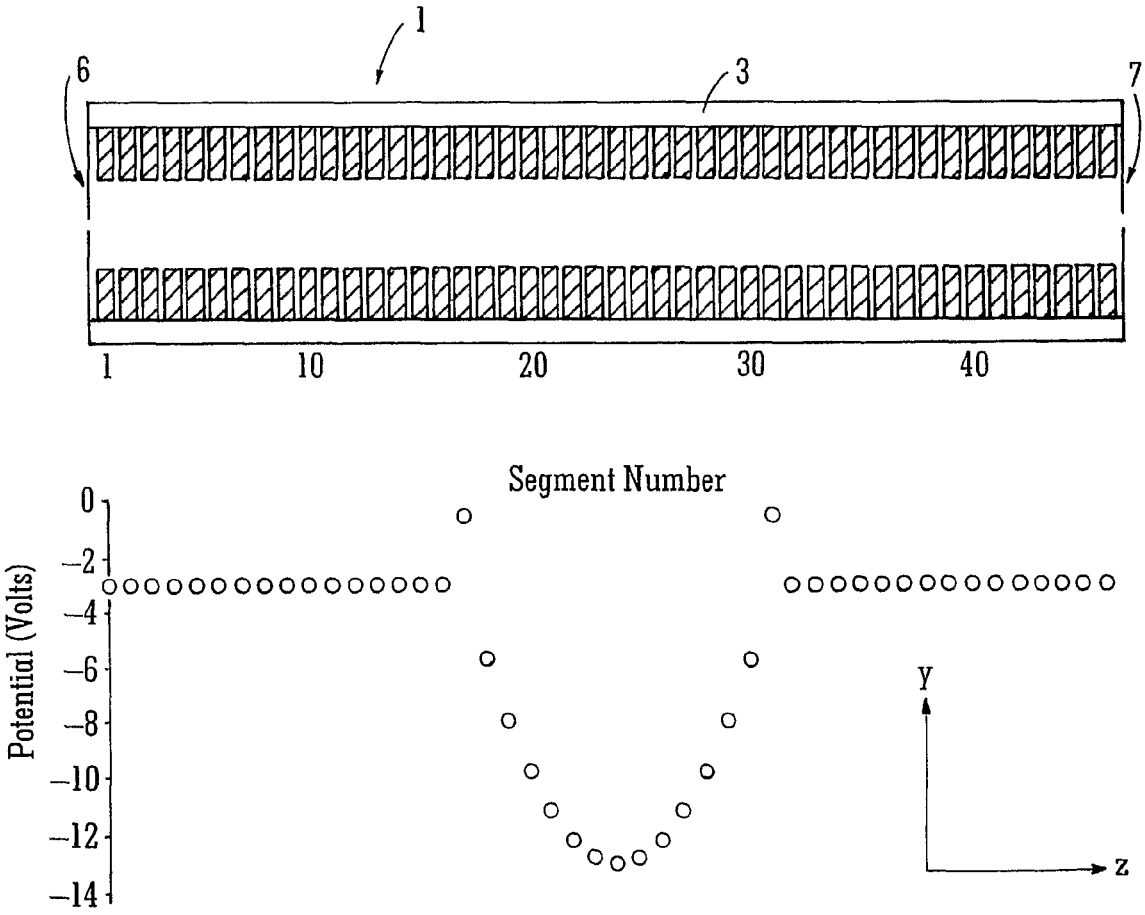
FIG. 2 shows a schematic diagram of an ion trap according to a preferred embodiment in the z,y plane.

FIG. 2 shows an ion trap or ion guide 1 according to the preferred embodiment and viewed in the y,z plane. Two segmented individual rods can be seen each comprising 46 axial rod segments. The entrance aperture plate 6 and the exit aperture plate 7 are also shown. The axial rod segments and the entrance and exit plates 6,7 are preferably connected to separate DC supplies. A plot of the potential of each axial rod segment is also shown in FIG. 2. Ions are preferably arranged to be trapped in a quadratic axial potential well located around the centre of the ion trap 1 before ions are excited parametrically and ejected. Less preferred embodiments are contemplated wherein the potential profile maintained in the z direction along the length of the ion trap prior to parametrically exciting ions has a non-quadratic form.

An alternating Radio Frequency (RF) voltage is preferably applied to all the axial rod segments comprising the four rods 2*a*,2*b* so that radial pseudo-potential well is created which preferably acts to confine ions in the x,y or radial direction within the ion trap 1. With reference to FIG. 1, the potential applied to the first electrode pair 2*a* is given by:

$$\phi_1=\phi_o\cos(\Omega\cdot t) \tag{19}$$

The potential applied to the second electrode pair 2*b* is given by:

$$\phi_2=-\phi_o\cos(\Omega\cdot t) \tag{20}$$

wherein $\phi_o$ is the 0-peak voltage of a radio frequency high voltage power supply, t is the time in seconds and Ω is the angular frequency of the AC supply in radians/second.

The potential in the x,y direction is approximated by:

$$\phi_{x,y}=\phi_o\cos(\Omega\cdot t)\frac{(x^2-y^2)}{2\cdot r_o^2} \tag{21}$$

wherein $r_o$ is the radius of an imaginary circle enclosed within the two pairs of electrodes.

Ion motion in the x,y axis may be expressed in terms of a Mathieu type equation. The ion motion preferably comprises of low amplitude micro motion with a frequency related to the initial RF drive frequency and a larger secular motion with a frequency related to the mass to charge ratio of the ion. The properties of this equation are well established and solutions resulting in stable ion motion are generally represented using a stability diagram by plotting the stability boundary conditions for the dimensionless parameters $a_u$ and $q_u$.

According to the preferred embodiment:

$$a_u=a_x=-a_y=\frac{8qU_0}{m\Omega^2r_0^2} \tag{22}$$

$$q_u=q_x=-q_y=\frac{4q\phi_0}{m\Omega^2r_0^2} \tag{23}$$

wherein m is the molecular mass of the ion, $U_0$ is a DC voltage applied to one of the pairs of electrodes with respect to the other pair, q is the electron charge (e) multiplied by the number of charges on the ions (z):

$$q=z\cdot e \tag{24}$$

The operation of such a quadrupole device for mass analysis is well known.

The application of an RF voltage as described above results in the formation of a pseudo-potential well in the radial direction. An approximation of the pseudo-potential well in the x direction is given by:

$$V^*_{(x)} = \frac{q \cdot \phi_0^2 \cdot x^2}{4 \cdot \Omega \cdot m \cdot r_0^4} \tag{25}$$

The depth of the pseudo-potential well is approximately:

$$\overline{D}_x = \frac{q_x \cdot \phi_0}{8} \tag{26}$$

for values of $q_z<0.4$.

As the quadrupole rod set is cylindrically symmetrical an identical expression may be derived for the characteristics of the pseudo-potential well in the y axis.

In addition to the RF trapping potential the various axial segments or pairs of electrodes 2*a*,2*b* are also preferably maintained at different DC potentials. The DC potential profile applied to or maintained along the length of the ion guide 1 preferably has a minimum at the electrode segment positioned at the centre or middle of the ion trap 1 i.e. the twenty-third electrode. The DC potential preferably increases as the square of the distance away from the centre of the ion trap 1.

The DC potential applied in the z direction therefore preferably has the form:

$$U_z = \frac{k \cdot z^2}{2} \tag{27}$$

where:

$$k = \frac{2DC_z}{L^2} \tag{28}$$

wherein $DC_z$ is the depth of the axial potential well and L is one half of the length of the axial potential well.

The electric field $E_z$ in the z direction is given by:

$$E_z = \frac{\delta U_z}{\delta z} = k \cdot z \tag{29}$$

The force $F_z$ in the z direction is given by:

$$F_z = -q \cdot E_z = -q \cdot k \cdot z \tag{30}$$

The acceleration $A_z$ along the z-axis is given by:

$$A_z = \ddot{z} = -\frac{q}{m} \cdot k \cdot z \tag{31}$$

The restoring force on a particular ion is directly proportional to the axial displacement of an ion from the centre of the superimposed DC potential well. Under these conditions ions will undergo simple harmonic oscillations in the z direction.

The exact solution to Eqn. 31 above is given by:

$$z(t) = z_0 \cos(\omega \cdot t) + \sqrt{(2 \cdot V/k)} \cdot \sin(\omega \cdot t) \tag{32}$$

wherein V is the initial accelerating potential applied to the ion in the z direction and $z_0$ is the initial z coordinate of the ion. Also:

$$\omega = \sqrt{q \cdot k/m} \tag{33}$$

wherein ω is the angular frequency of the oscillations in the axial direction.

From this equation it is apparent that the angular frequency of oscillation in the axial direction is independent of the initial energy and the starting position of an ion. The frequency is only dependent upon the mass to charge ratio (m/q) and the field strength constant (k).

The DC voltage applied to each individual rod segment is preferably generated using separate individual low voltage power supplies. The outputs of the low voltage power supplies are preferably controlled by a programmable microprocessor. The general form of the electrostatic potential function in the axial direction can preferably be manipulated in a substantially rapid manner. In addition, complex and/or time varying potential functions may also be superimposed onto the axial rod segments along the axial length of the ion trap 1.

The DC potential distribution may be modified empirically to produce optimum performance. For example, the DC potential distribution may be modified to allow axial ejection to occur preferentially in one direction or the other.

It will also be apparent that various different electrostatic potential trapping profiles may initially be maintained along the length of the ion trap 1 without deviating from the principles of the preferred embodiment as described above.

According to the preferred embodiment a further or supplemental time varying AC potential or voltage is preferably superimposed to the axial rod segments. The further or supplemental time varying AC potential or voltage is preferably applied such that the time varying potential has a minimum or maximum at the centre or middle of the ion trap 1. The supplemental AC potential preferably increases substantially as the square of the distance away from the centre of the ion trap 1.

The overall potential applied along the axial length of the ion trap 1 may therefore be described by:

$$U_z(t) = \frac{k \cdot z^2}{2} + \frac{b \cdot z^2}{2} \cos(\sigma t) \tag{34}$$

wherein σ is the angular frequency of the further or supplemental AC potential or voltage and b is a field constant for the further AC potential or voltage. Also:

$$b = \frac{2 \cdot AC_z}{L^2} \tag{35}$$

wherein $AC_z$ is the maximum 0 to peak alternating potential applied to the axial rod segments and L is one half of the length of the axial potential well.

It can be seen that the periodic term in Eqn. 34 is described by equation 5 when n=0 and $C_0$=b.

The electric field $E_z$ in the axial direction is given by:

$$E_z(t) = \frac{\delta U_z}{\delta z} = k \cdot z + bz\cos(\sigma t) \tag{36}$$

The force $F_z$ in the z direction is given by:

$$F_z(t) = -q \cdot E_z(t) = -q(k \cdot z + bz \cos(\sigma t)) \tag{37}$$

The acceleration $A_z$ along the z-axis is given by:

$$A_z(t) = \ddot{z} = -\frac{q}{m} \cdot (k \cdot z + bz\cos(\sigma t)) \tag{38}$$

The equation of motion of an ion in the z direction is therefore given by:

$$\ddot{z} + \frac{q}{m} \cdot (k \cdot + b\cos(\sigma t))z = 0 \tag{39}$$

This equation is a form of the Mathieu equation which can be written as:

$$\ddot{z} + \frac{\sigma^2}{4} \cdot (a_z \cdot -2q_z\cos(\sigma t))z = 0 \tag{40}$$

wherein $a_z$ and $q_z$ are dimensionless parameters.

$$a_z = \frac{4qk}{m\sigma^2} \tag{41}$$

$$q_z = \frac{-2qb}{m\sigma^2} \tag{42}$$

Eqns. 41 and 42 may be rewritten:

$$a_z = \frac{4\omega^2}{\sigma^2} \tag{43}$$

$$q_z = \frac{-2\omega^2 b}{\sigma^2 k} \tag{44}$$

Solutions to Eqn. 39 are either periodic and stable or alternatively periodic and unstable. In practice, unstable solutions represent situations wherein ions will be axially ejected from the ion trap 1. The boundaries of the regions of stability may be plotted as a function of the dimensionless parameters defined in Eqns. 41 and 42 $q_z$ and $a_z$.

Figure 3:
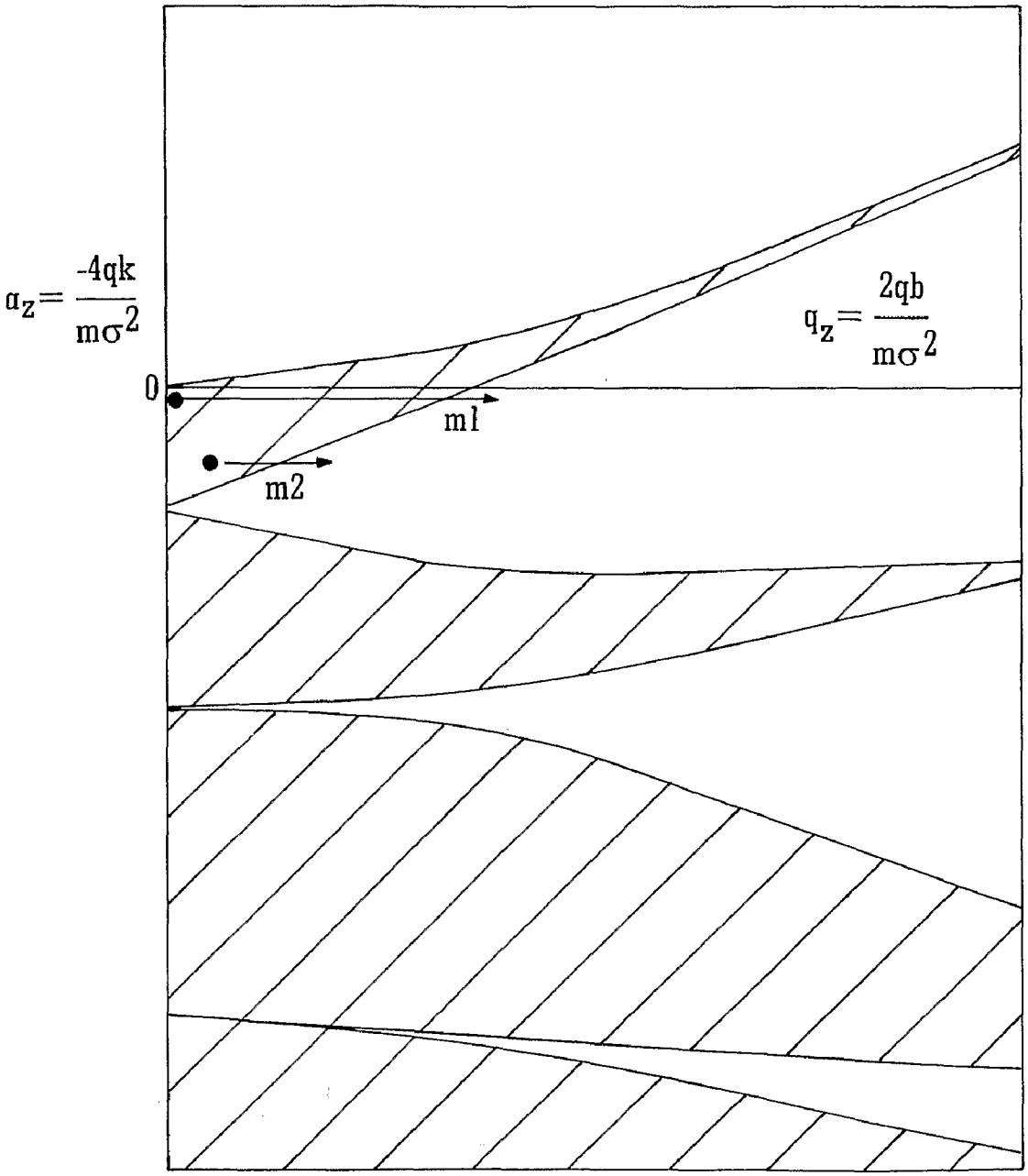
FIG. 3 shows a stability diagram for the preferred embodiment in the z direction showing analytical scan lines for mass to charge ratios m1 and m2 wherein m1>m2.

A stability diagram for ion motion in the axial direction is shown in FIG. 3. Regions of stability are shown as shaded regions and regions of instability are shown as un-shaded regions.

To satisfy the Laplace equation the potential in x,y,z directions due to the superimposed quadratic field is of the form:

$$U_{x,y,z} = \frac{k}{2}z^2 + A(x, y) \tag{45}$$

Where:

$$\frac{\delta^2 x}{\delta x^2} + \frac{\delta^2 y}{\delta y^2} = -k \tag{46}$$

This condition implies that by superimposing a symmetrical static quadratic potential and thus a linear electric field along the axis of the ion trap 1 a static radial electric field is also created. When ions experience this radial electric field the ions will be accelerated outwards towards the rod electrodes. However, as long as the radial pseudo-potential well created by the application of the AC or RF voltage to the rod electrodes is sufficient to overcome the radial force exerted on an ion, then the ions will remain confined radially within the ion trap 1.

The overall radial electric field produced as a result of the superimposition of the static and the alternating axial fields may be approximated by:

$$Uz_r(t) = \frac{r}{L^2}(DC_z + AC_z\cos(\sigma t)) \tag{47}$$

Accordingly, the complete differential equation of motion for ions in the radial direction becomes:

$$\ddot{r} + \frac{q}{m}\left[\frac{U_0}{r_0^2} - \frac{DC_z}{L^2} + \phi_0\cos(\Omega t) - \frac{AC_z}{L^2}\cos(\sigma t)\right]r = 0 \tag{48}$$

The solutions to this form of equation are complex. Again a stability diagram may be drawn. However, the stability diagram occupies three dimensional space and can be expressed in terms of the dimensionless parameters a, q and q'. The parameters a and q are dimensionless parameters defined by the general form of the Mathieu equation and q' is a dimensionless parameter related to the frequency and amplitude of the radial field modulation occurring as a result of modulation of the field in the axial direction. Analytical and numerical approaches to solutions of this form of equation are known.

In the preferred embodiment ions are preferably introduced into the ion trap 1 via an external ion source. The ions may be introduced into the ion trap 1 in either a pulsed or a continuous manner. If a continuous beam of ions is introduced into the ion trap 1 from an external source then the initial axial energy of the ions entering the ion trap 1 is preferably arranged so that all ions having specific mass to charge ratios within a particular range are preferably confined by the radial RF field and are trapped axially by the axial electrostatic potential well. The electrostatic potential well may be quadratic or may alternatively have a different profile. The minimum of the electrostatic axial potential well preferably corresponds with the centre of the ion trap 1 although other embodiments are contemplated wherein the minimum of the electrostatic axial potential well is displaced from the centre or middle of the ion trap 1. When ions are preferably introduced into the ion trap 1 the amplitude of the modulation of the superimposed or supplemental axial AC electric field is preferably set to zero.

According to an embodiment the initial energy spread of ions confined in the ion trap 1 may be reduced by introducing a cooling gas into the ion confinement region of the ion trap 1 at a pressure in the range $10^{-5}$-$10^{1}$ mbar or more preferably in the range $10^{-3}$-$10^{-1}$ mbar. The ions will preferably lose their kinetic energy due to collisions with gas molecules. The ions will preferably be thermalised i.e. the ions will preferably reach thermal energies and the ions will preferably migrate to the point of lowest electrostatic potential along the axis of the ion trap 1. The spatial and energy spread of the ions is therefore preferably minimised.

Ions may initially be trapped in the ion trap 1 with a cooling gas present within the ion trap 1. Alternatively, the ions may be trapped in the ion trap 1 without cooling gas being present.

If cooling gas is present in the ion trap 1 then collisions between ions and residual gas molecules will preferably eventually cause the amplitude of the oscillations of the rows to decrease. As a result the ions will tend to collapse or move towards the centre of the electrostatic axial potential well. Ions are preferably not lost from the ion trap 1 since they preferably remain confined radially within the ion trap 1 by the radial pseudo-potential well.

According to the preferred embodiment once ions are cooled and are preferably confined within the ion trap 1 around the minimum of the electrostatic potential well the shape of the electrostatic axial potential well is preferably caused to be quadratic (if the axial potential well was not already quadratic). A supplemental axial AC potential is then preferably applied to the electrodes of the ion trap 1. The amplitude of the supplemental axial AC potential is preferably increased or scanned whilst maintaining the frequency of modulation substantially constant. The various regions of stability in the axial direction are shown as shaded regions in FIG. 3. As the amplitude of the supplemental AC voltage is increased then ions are preferably mass selectively ejected from the ion trap 1. The mass selective ejection of ions from the ion trap 1 may be accomplished in a number of different ways.

According to an embodiment mass selective ejection may be accomplished by progressively increasing the amplitude of the supplemental AC voltage or potential which is applied to the electrodes of the ion trap 1 whilst maintaining the frequency σ of the supplemental AC voltage or potential substantially constant. FIG. 3 shows an example of a scan line for two ions having mass to charge ratios m1 and m2 wherein m1>m2 and wherein the amplitude of the supplemental AC voltage or potential is increased whilst keeping the frequency of the supplemental AC voltage or potential substantially constant. Selected ions move from a region of stability to a region of instability and hence are ejected from the ion trap 1.

Figure 4:
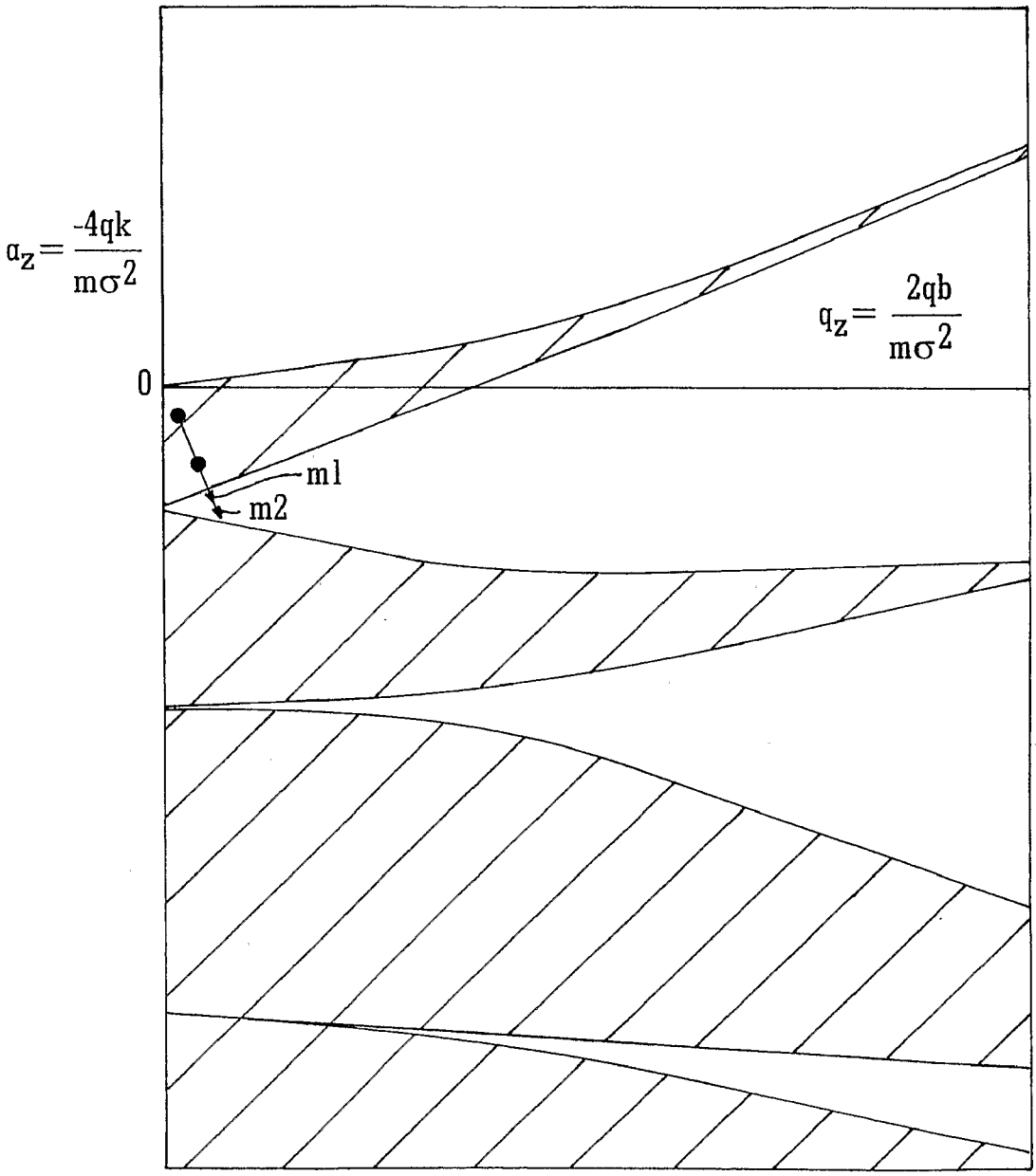
FIG. 4 shows a stability diagram for the preferred embodiment in the z direction showing alternative analytical scan lines for mass to charge ratios m1 and m2 wherein m1>m2.

According to another embodiment mass selective ejection of ions from the ion trap 1 may be achieved by decreasing the frequency σ of modulation of the supplemental AC voltage or potential whilst maintaining the amplitude of the supplemental AC voltage or potential substantially constant. FIG. 4 shows an example of a scan line for two ions having mass to charge ratios m1 and m2 wherein m1>m2 and wherein the frequency of modulation of the supplemental AC voltage or potential is progressively decreased whilst the amplitude of the supplemental AC voltage is kept substantially constant. Selected ions moved from a region of stability to a region of instability and hence are ejected from the ion trap 1.

Figure 5:
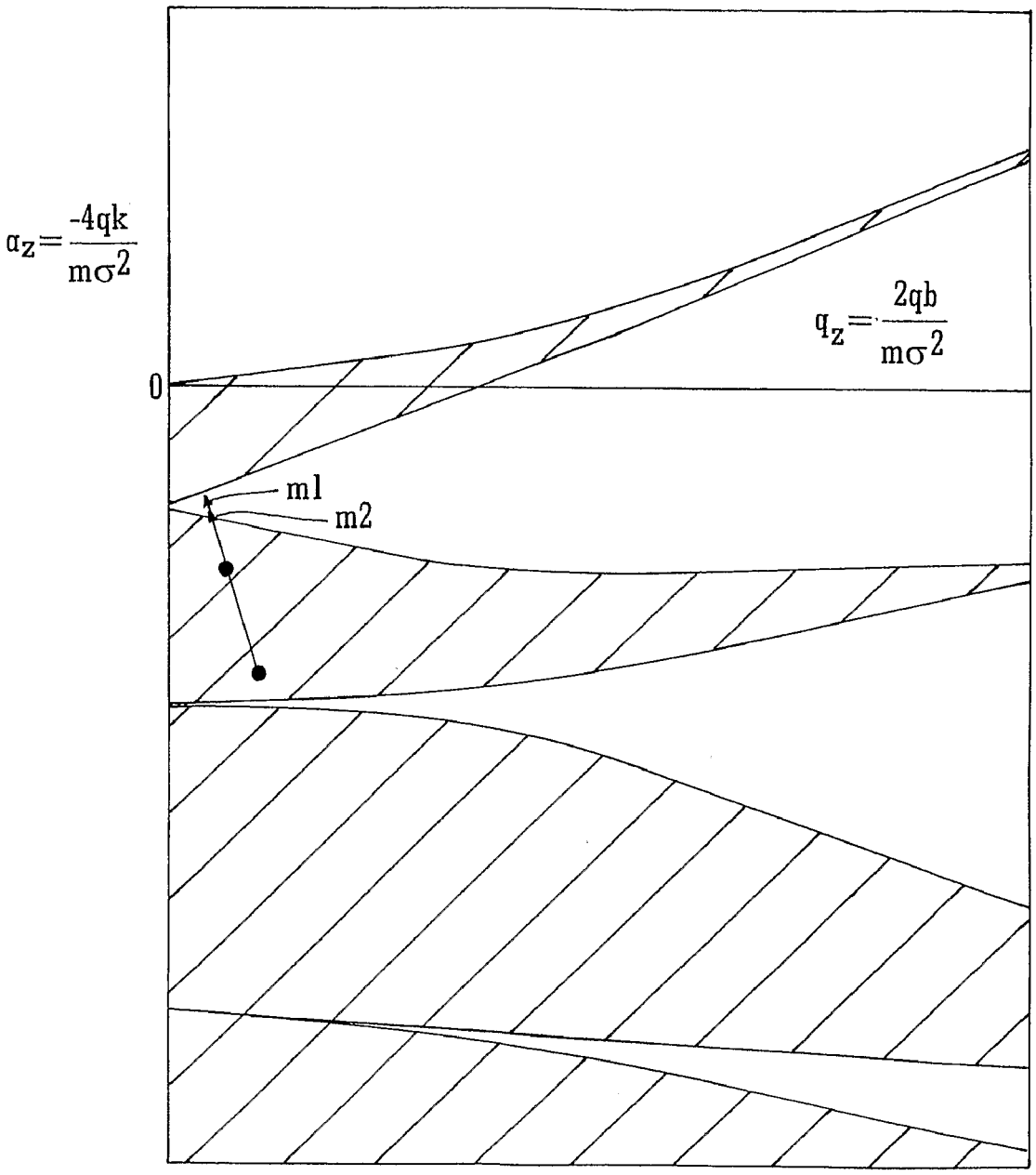
FIG. 5 shows a stability diagram for the preferred embodiment in the z direction showing alternative analytical scan lines for mass to charge ratios m1 and m2 wherein m1>m2.

Mass selective ejection of ions from the ion trap 1 may also be achieved by increasing the frequency σ of modulation of the supplemental AC voltage or potential whilst maintaining the amplitude of the AC voltage or potential substantially constant. FIG. 5 shows an example of a scan line for two ions having mass to charge ratios m1 and m2 wherein m1>m2 and wherein the frequency of the supplemental AC voltage or potential is progressively increased whilst the amplitude of the supplemental AC voltage or potential is kept substantially constant. Selected ions move from a region of stability to a region of instability and hence are ejected from the ion trap 1.

Figure 6:
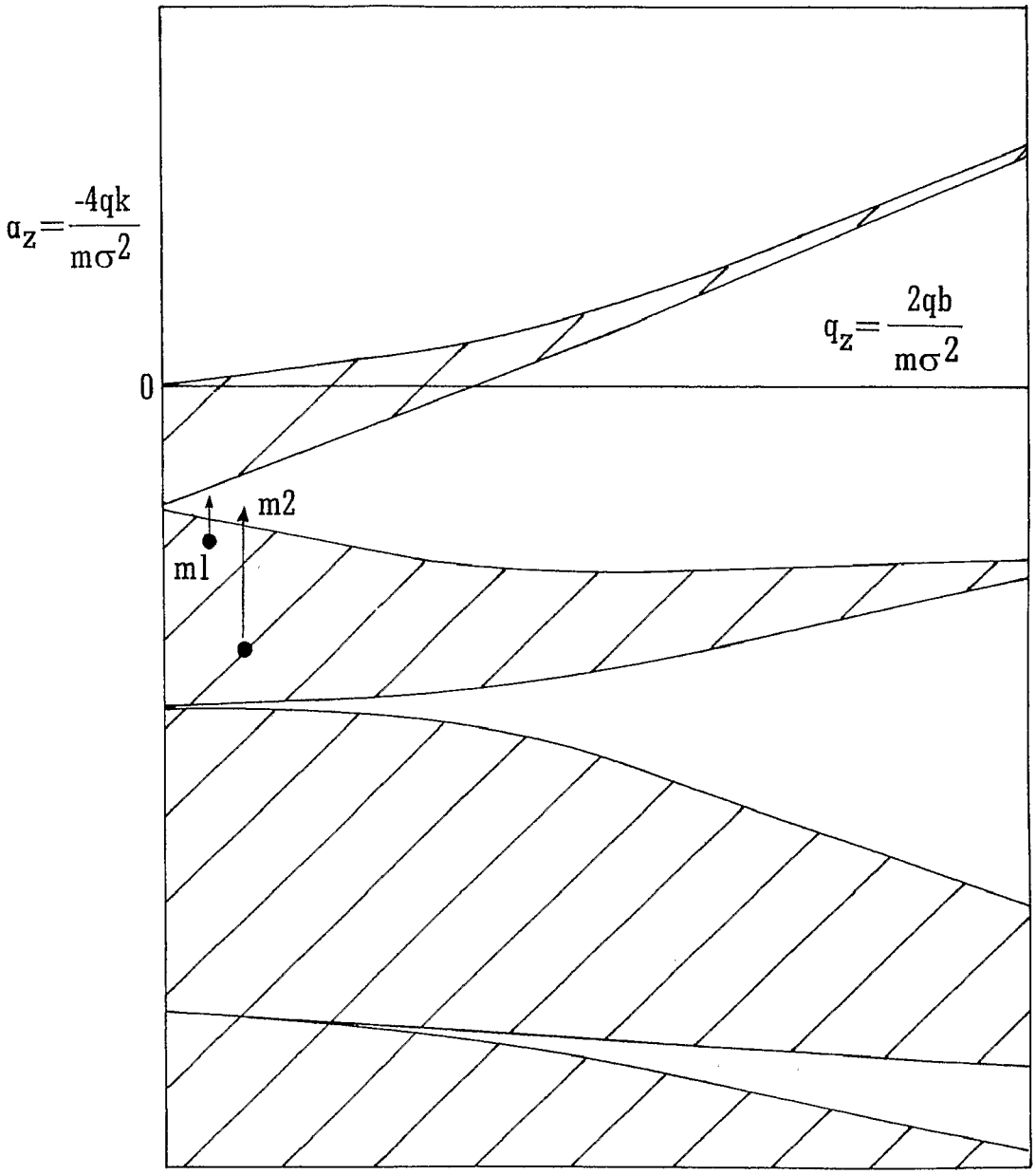
FIG. 6 shows a stability diagram for the preferred embodiment in the z direction showing alternative analytical scan lines for mass to charge ratios m1 and m2 wherein m1>m2.

Mass selective ejection of ions from the ion trap 1 may also be accomplished by altering the depth of the electrostatic quadratic potential well whilst maintaining the amplitude and the frequency of the supplemental AC voltage or potential substantially constant. The amplitude and/or frequency of AC or RF voltage applied to the electrodes in order to cause ions to be confined radially within the ion guide or ion trap 1 may also be altered in order to ensure the radial stability of the ions of interest. FIG. 6 shows an example of a scan line for two ions having mass to charge ratios m1 and m2 wherein m1>m2 and wherein the depth of the electrostatic quadratic potential well is decreased with time whilst the amplitude and the frequency of the supplemental AC voltage or potential is maintained substantially constant. Selected ions move from a region of stability to a region of instability and hence are ejected from the ion trap 1.

According to a yet further embodiment mass selective ejection of ions from the ion trap 1 may be accomplished by varying both the amplitude and the frequency C of the supplemental AC voltage or potential.

According to other embodiments mass selective ejection of ions from the ion trap 1 may be accomplished by a combination of the above mentioned methods of mass selective ejection.

It is apparent that various different analytical scans may be performed using combinations of the parameters describing $a_z$ and $q_z$.

Ions which are ejected from the ion trap 1 are preferably detected by an ion detector. The ion detector may comprise a MCP micro channel plate, channeltron or discrete dynode electron multiplier. The ion detector may alternatively comprise a conversion dynode, phosphor or scintillator in combination with a photo multiplier. The ion detector may also comprise various combinations of the above mentioned types of ion detectors.

According to one embodiment ions ejected from the ion trap 1 may be onwardly transmitted to a collision, fragmentation or reaction device. Alternatively, ions ejected from the ion trap 1 may be onwardly transmitted to another mass analyser or another stage of the mass spectrometer.

According to an embodiment an ion trap mass analyser 1 according to the preferred embodiment may be coupled to a scanning/stepping device such as a quadrupole rod set mass filter or mass analyser which is preferably provided downstream of the ion trap mass analyser 1. The combination of an ion trap mass analyser 1 according to the preferred embodiment and a quadrupole rod set mass filter or mass analyser arranged downstream of the ion trap mass analyser 1 and which is scanned in use preferably in synchronism with the ion trap mass analyser 1 preferably enables a mass spectrometer to be provided which has an improved overall instrument duty cycle and sensitivity.

Figure 7:
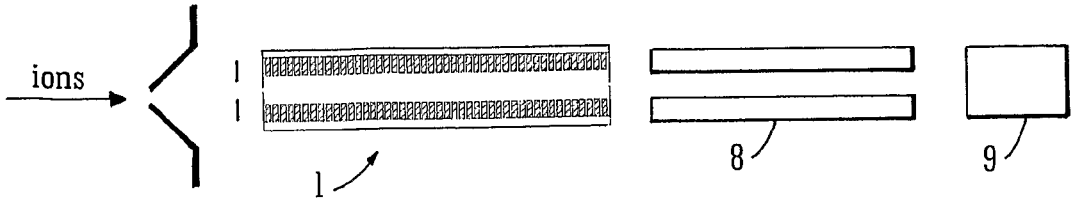
FIG. 7 shows a preferred ion trap mass analyser arranged upstream of a scanning quadrupole mass filter.

FIG. 7 shows a mass spectrometer according to an embodiment wherein a quadrupole rod set mass filter or mass analyser 8 is provided downstream of a preferred ion trap mass analyser 1. The ions ejected from the ion trap 1 will preferably have a mass to charge ratio which varies as a function of time. At any given time the mass to charge ratio range of ions exiting the ion trap 1 will therefore preferably be restricted or relatively narrow. Therefore, ions having a particular mass to charge ratio will preferably exit the preferred ion trap mass analyser 1 over a relatively short period of time. If the mass to charge ratio transmission window of the scanning quadrupole rod set 8 is substantially synchronised with the mass to charge ratio range of ions exiting the ion trap 1 then the duty cycle of the scanning quadrupole rod set mass filter or mass analyser 8 will be increased.

According to another embodiment the mass to charge ratio transmission window of the quadrupole rod set mass filter or mass analyser 8 may be stepped to a limited number of predetermined values in a substantially synchronised manner with the mass to charge ratio of ions of interest exiting the ion trap mass analyser 1. According to this embodiment the transmission efficiency and duty cycle of the quadrupole rod set mass filter or mass analyser 8 may be increased for a mode of operation wherein only ions having certain specific mass to charge ratios are desired to be measured.

Figure 8:
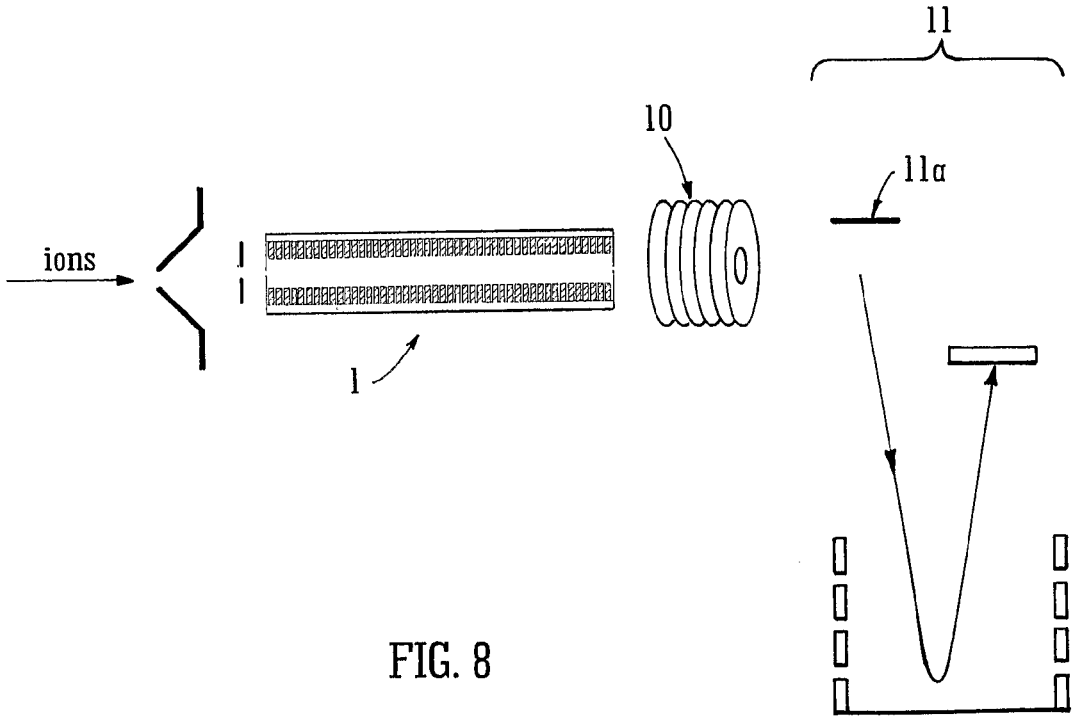
FIG. 8 shows a preferred ion trap mass analyser arranged upstream of an orthogonal acceleration Time of Flight mass analyser.

Another embodiment of the present invention is shown in FIG. 8. According to this embodiment an ion trap mass analyser 1 according to the preferred embodiment is coupled to an orthogonal acceleration Time of Flight mass analyser 11 which is preferably arranged downstream of the preferred ion trap mass analyser 1. An ion guide 10 is preferably provided between the preferred ion trap mass analyser 1 and the orthogonal acceleration Time of Flight mass analyser 11. The ion guide 10 preferably comprises a plurality of electrodes having apertures through which ions are preferably transmitted in use. The ion guide 10 preferably transports ions which emerge from the ion trap mass analyser 1 to the orthogonal acceleration Time of Flight mass analyser 11 and preferably improves the duty cycle and sensitivity of the overall mass spectrometer. One or more transient DC voltages or potentials or one or more transient DC voltage or potential waveforms may preferably be applied to the electrodes of the ion guide 10 so that a plurality of real axial potential wells are preferably created within the ion guide 10 which are then translated along the length of the ion guide 10. The mass to charge ratio of ions outputting or exiting from the ion trap 1 preferably varies as a function of time. As a result, the ion guide 10 preferably effectively samples packets of ions as they are ejected from the preferred ion trap mass analyser 1 such that packets of ions having a limited range of mass to charge ratios are preferably trapped in separate real axial potential wells which are preferably translated along the length of the ion guide 10. The axial potential wells are preferably continually transported or translated along the length of the ion guide 10 such that ions are preferably translated from the entrance of the ion guide 10 to the exit of the ion guide 10. As the ions reach the end of the ion guide 10 the ions are then preferably released into or towards the orthogonal acceleration Time of Flight mass analyser 11. The orthogonal acceleration Time of Flight mass analyser 11 preferably comprises an orthogonal acceleration or extraction electrode 11*a*. An orthogonal acceleration extraction pulse is preferably applied to the orthogonal acceleration electrode 11*a*. The timing of the orthogonal acceleration extraction pulse is preferably synchronised with the release of a packet of ions from the ion guide 10 so as to maximise the transmission of ions released from a given axial potential well from the ion guide 10 into the drift or time of flight region of the orthogonal acceleration Time of Flight mass analyser 11.

A further embodiment of the present invention is contemplated wherein ions may also be excited at the resonance or fundamental harmonic frequency in addition to being parametrically excited in order to cause ions to be mass selectively ejected from the ion trap 1.

The preferred ion trap mass analyser 1 may be used in an MS mode of operation to mass analyse parent or precursor ions. Alternatively, the ion trap mass analyser 1 may be used for $MS^n$ experiments wherein parent or precursor ions are fragmented and resulting first or further generation fragment or daughter ions are then mass analysed.

According to an embodiment specific parent or precursor ions may be selected and retained within the ion trap 1 using the well-known radial stability characteristics of a RF quadrupole. A dipolar or quadrupolar excitation voltage or resolving DC voltage may be applied to the electrodes of the ion trap 1 in order to reject certain ions having particular mass to charge ratios either as the ions enter the preferred ion trap mass analyser 1 or once ions are trapped within the ion trap mass analyser 1.

According to another embodiment parent or precursor ion selection may be accomplished using axial resonance or axial parametric excitation to effect ion ejection from the axial electrostatic potential well. In this case a broad band of excitation frequencies may be applied simultaneously in order to eject ions axially from the electrostatic axial potential well. All ions with the exception of those parent or precursor ions which are desired to be analysed are preferably caused to be ejected from the ion trap 1. The method of inverse Fourier transform may be employed in order to generate a suitable broadband waveform for resonance ejection of a broad range of ions whilst leaving specific parent or precursor ions trapped within the ion trap 1.

According to another embodiment parent or precursor selection may be accomplished using a combination of axial resonance ejection and mass selective parametric instability to eject ions from the electrostatic axial potential well.

Collision gas may be introduced in the ion trap 1 and selected parent or precursor ions may be fragmented by increasing the amplitude of oscillation and therefore the velocity of the ions in the axial direction using resonance excitation and/or parametric excitation. Alternatively, selected parent or precursor ions may be fragmented by increasing the amplitude of oscillation and therefore the velocity of the ions in the radial direction by altering the frequency and/or amplitude of the voltage applied to the segmented quadrupole rods or by superimposing a suitable dipolar or quadrupolar excitation waveform to one pair of the segmented quadrupole rods. A combination of the above mentioned techniques may also be used to excite the selected parent or precursor ions to possess sufficient energy for fragmentation to occur. The resulting fragment ions are then preferably mass analysed by any of the methods described above within the ion trap 1.

The process of ion selection and excitation may be repeated to allow $MS^n$ experiments to be performed. The resultant $MS^n$ ions produced may be axially ejected using the methods previously described.

Figure 9:
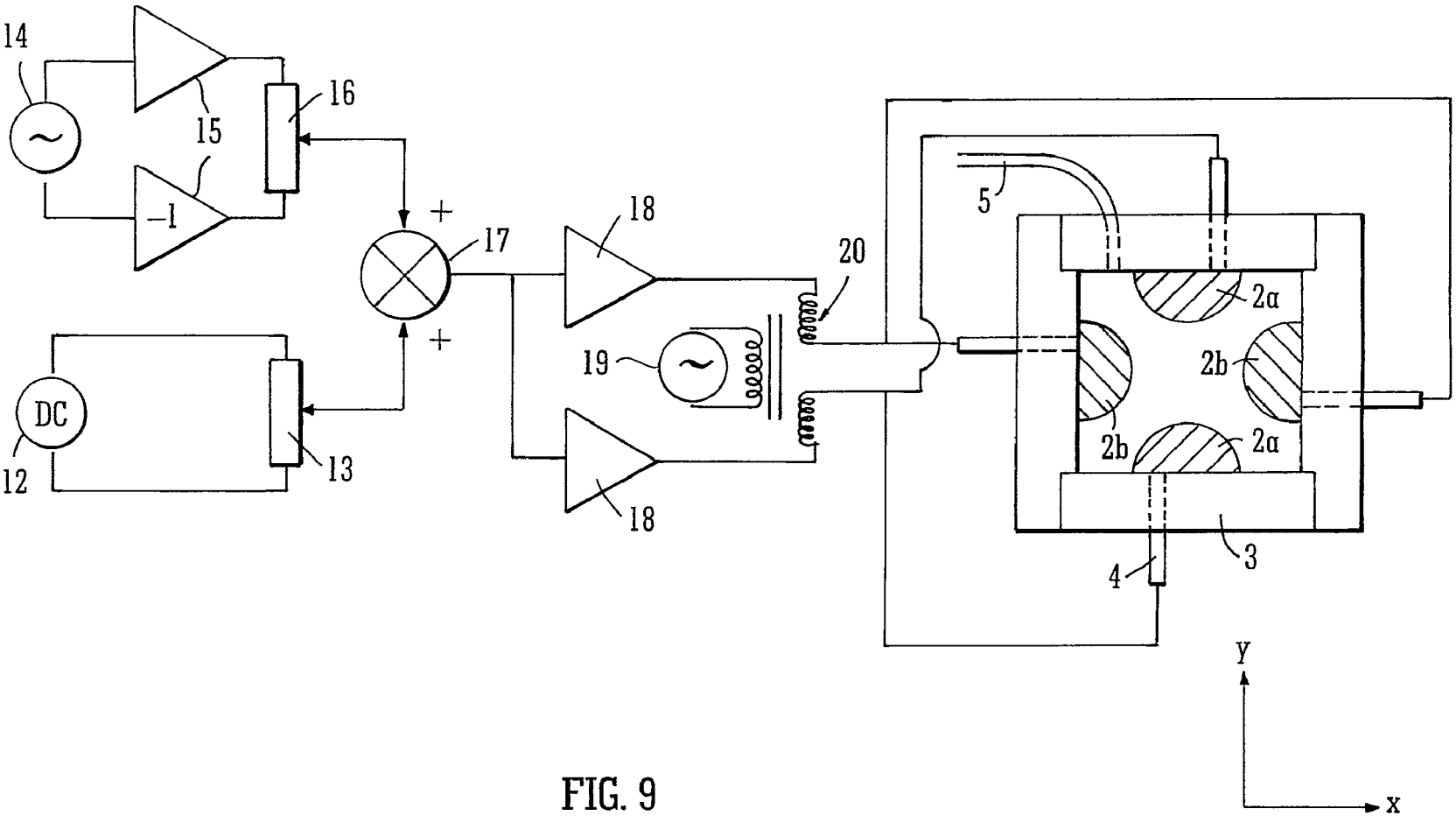
FIG. 9 shows electronic components and connections to a preferred ion mass analyser.

FIG. 9 shows a schematic diagram of the various electrical connections made to an individual axial segment of the rod set of the preferred ion trap mass analyser 1. The components shown are duplicated for each individual axial segment of the rod set apart from the power supplies 12,14 and the inverting amplifier 15. DC voltage supply 12 preferably provides a voltage to each axial segment. The potential on each segment is preferably adjusted using a variable resistor 13. A separate variable resistor is preferably provided for each axial segment of the ion trap 1 thereby enabling any desired static potential function to be applied or maintained along the length of the ion trap 1. The supplemental AC current or voltage supply 14 which is preferably used to excite ions parametrically within the ion trap 1 is preferably fed into two unity gain amplifiers one of which is preferably inverting. The combined output of the two amplifiers is preferably adjusted by a variable resistor 16. This allows the AC or RF signal applied to individual axial segments to be adjusted in terms of peak-to-peak amplitude and for the phase of the waveform to be changed by 180 degrees. A separate variable resistor 16 is preferably provided for each axial segment of the ion trap 1. The outputs of the variable resistors 13,16 are preferably fed into an adding circuit 17. The combined DC and AC signal for an individual axial segment is then preferably fed into two amplifiers 18. A second AC voltage at RF frequency is then preferably added to this signal via an RF power supply 19 and transformer 20. This RF signal is preferably common to all the segments of the ion trap 1 and preferably causes a radial pseudo-potential well to be formed which preferably causes ions to be confined radially within the ion trap 1. Two outputs are preferably produced which differ only in the phase of the RF signal 19. Considering pairs of segments 2*a*,2*b* which are in the same x,y plane the two outputs are attached to opposing pairs of electrodes. Thus electrodes 2*a* will have the same static DC potential and supplemental AC excitation potential as electrodes 2*b* but the phase of the radial trapping RF potential will be 180 degrees different from that applied to electrodes 2*b*.

The supplemental AC excitation voltage waveform is preferably generated using an external sweep function generator. A sinusoidal modulation was used to obtain experimental data which are presented below. However, similar results were also obtained with square and triangular wave modulation. The preferred embodiment therefore includes square, triangular and other forms of modulation.

FIGS. 10A-10C show the form of the supplemental AC voltage applied to the electrodes in order to parametrically excite ions. FIG. 10A shows the excitation potential at a time T1 at which point the supplemental AC voltage waveform reaches maximum amplitude. The instantaneous potential in the z axis approximates a quadratic function over the region where ions are contained in an electrostatic potential well. FIG. 10B shows the excitation potential at a time T2 at which point the supplemental AC voltage waveform has zero amplitude. FIG. 10C shows the excitation potential at a time T3 at which point the supplemental AC voltage waveform has a minimum amplitude. The angular frequency of oscillation of the supplemental AC voltage waveform is given by:

$$\sigma = \frac{\pi}{(T3 - T1)} \tag{49}$$

Figure 11:
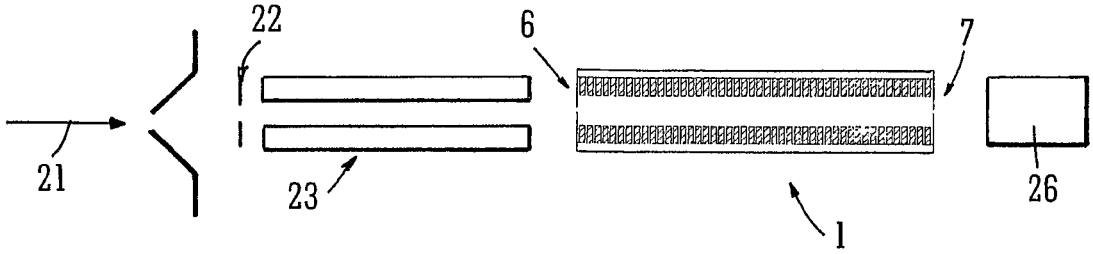
FIG. 11 shows a mass spectrometer according to an embodiment of the present invention as used to produce experimental data.

Experimental results were obtained using a mass spectrometer arranged as shown in FIG. 11. Positive ions were produced using an Electrospray ionisation ion source. The ions 21 were then passed to and through a conventional quadrupole rod set mass filter 23. The ions were then introduced axially into a preferred ion trap mass analyser 1. This allowed ions having mass to charge ratios within a specific range to be introduced into the ion trap 1 during a filling up period. An RF voltage was applied to the segmented rods of the ion trap 1 in order to cause ions to be confined radially within the ion trap 1. The RF voltage had an amplitude of 130 V (O-peak) and a frequency of $6.3\times10^6$ rad/sec. Helium buffer gas was introduced into the ion trap 1 to order to maintain an analyser pressure external to the ion trap 1 of $8\times10^{-6}$ mbar. An entrance plate electrode 6 arranged at the entrance to the ion trap 1 was maintained at a potential of −3V. An axial electrostatic potential well was generated as shown in FIG. 2. Initially, the supplemental AC excitation potential was set to zero.

A mixture of Polyethylene Glycol and Sulphadimethoxine was introduced into the Electrospray ion source. The quadrupole rod set mass filter 23 arranged upstream of the ion trap 1 was set to transmit ions having mass to charge ratios in the range 296 to 316. An exit plate 7 arranged at the exit of the ion trap 1 was set at +6 V. After a period of approximately 0.5 second to allow filling of the ion trap 1, the ion beam was stopped from reaching the ion trap 1 by raising the potential on an aperture plate 22 arranged upstream of the quadrupole rod set 23.

Once ions had been confined within the ion trap 1 the potential on the exit plate 7 was then lowered to −6 V. A supplemental parametric excitation waveform was then applied to the electrodes of the ion trap 1 and the frequency of the supplemental AC voltage was scanned from approximately 5,000 Hz to 50,000 Hz at a rate of approximately 5000 Hz per second with a maximum amplitude of 0.8 V using the function shown in FIG. 10. Ions ejected from the exit of the ion trap 1 were recorded using a photomultiplier detector 26 and Analogue To Digital recorder as the frequency of the supplemental AC voltage waveform was swept.

Figure 12:
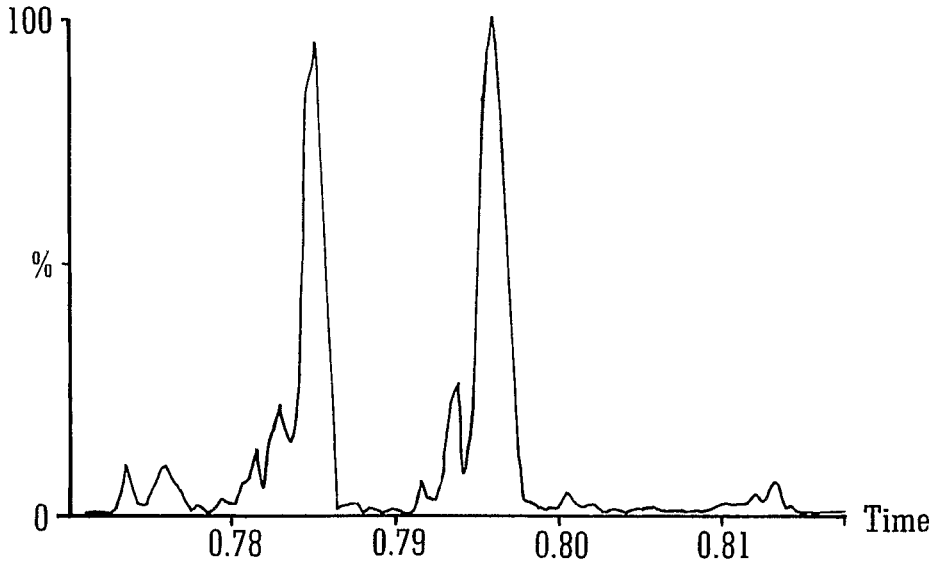
FIG. 12 shows a plot of the signal amplitude verses time as recorded by a photomultiplier ion detector when ions were ejected using the method of parametric excitation according to an embodiment of the present invention.

FIG. 12 shows the signal recorded at the detector 26 as a function of time for the parametric excitation experiment described above. The two most intense peaks correspond to the $(M+H)^+$ ion of Suphadimethoxine $(C_{12}H_1N_4O_4S)^+$ having a mass to charge ratio of 311 and the sodium adduct of polyethylene glycol $((C_2H_4O)_6+H_2O+Na)^+$ having a mass to charge ratio of 305.

Figure 13:
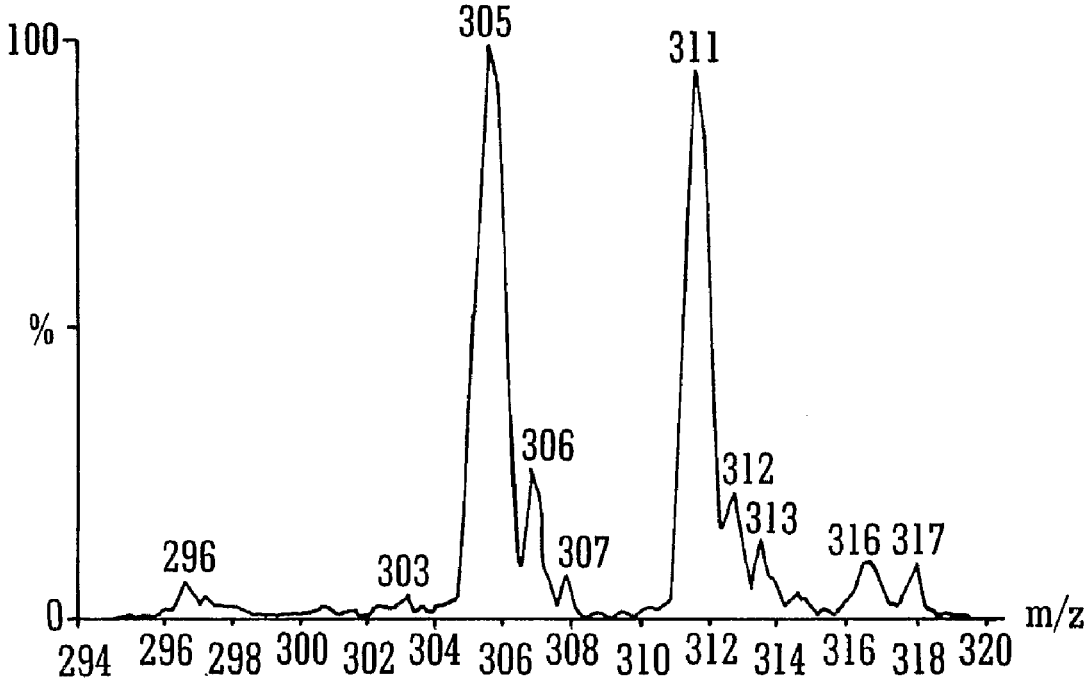
FIG. 13 shows the same data as shown in FIG. 12 after mass calibration.

FIG. 13 shows the same spectrum shown in FIG. 12 after mass calibration following the calibration law:

$$m \propto \left(\frac{1}{c_1 \cdot \sigma + c_2}\right)^2 \tag{50}$$

wherein m is the mass to charge ratio of the ion, $c_1$ and $c_2$ are calibration gain and offset coefficients respectively and σ is the frequency of the parametric excitation waveform.

The frequency of the supplemental AC voltage at which the ions were ejected was approximately 26,000 Hz. The measured mass resolution was approximately 350 FWHM.

For comparison ions having mass to charge ratios within the same range as shown in FIG. 13 (i.e. 296-316) were ejected from the ion trap 1 by a conventional resonance ejection approach.

Figure 10:
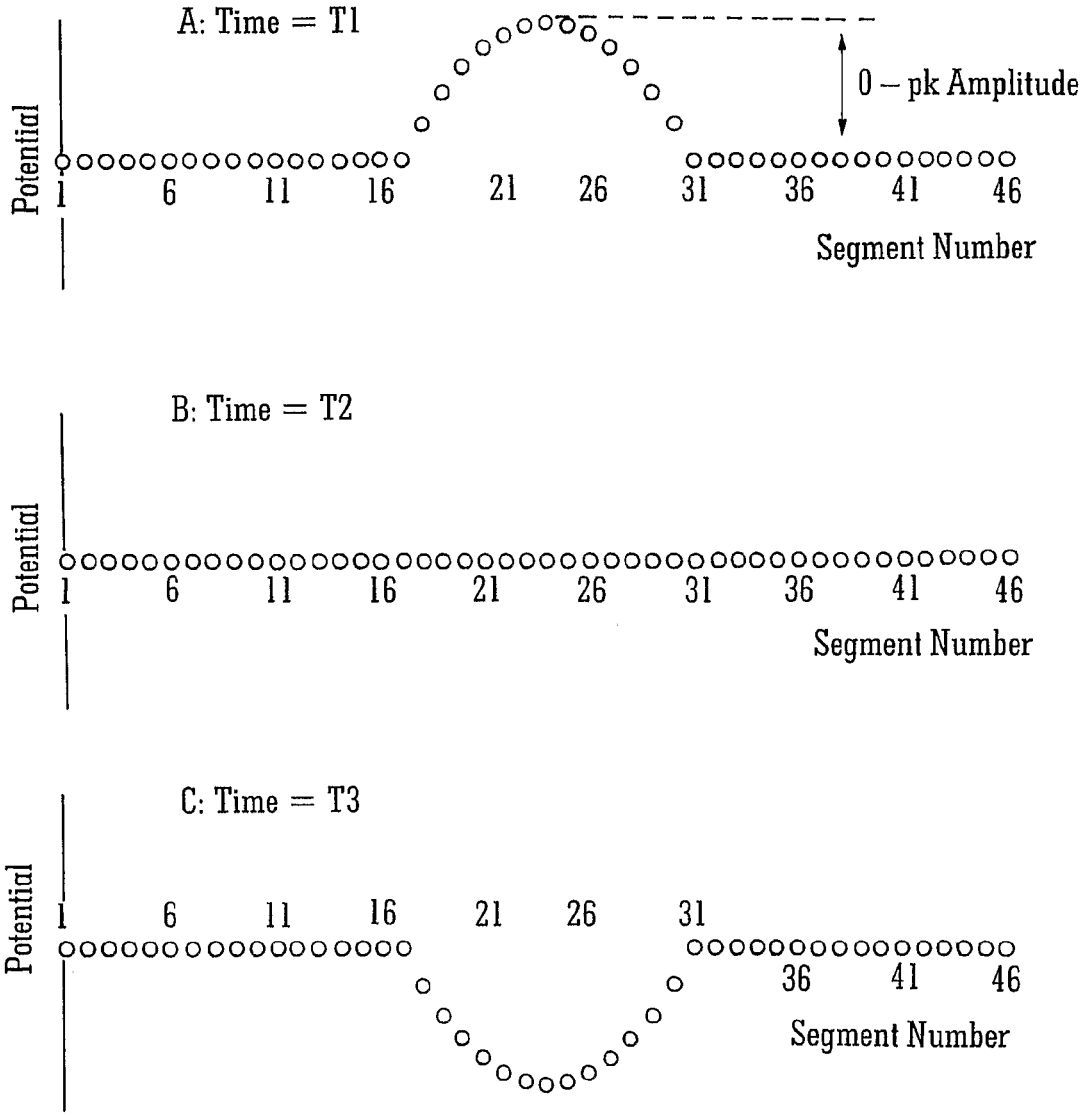
FIG. 10 shows the form of the modulated potential in the z axis used to eject ions by the method of parametric excitation according to an embodiment of the present invention.
Figure 14:
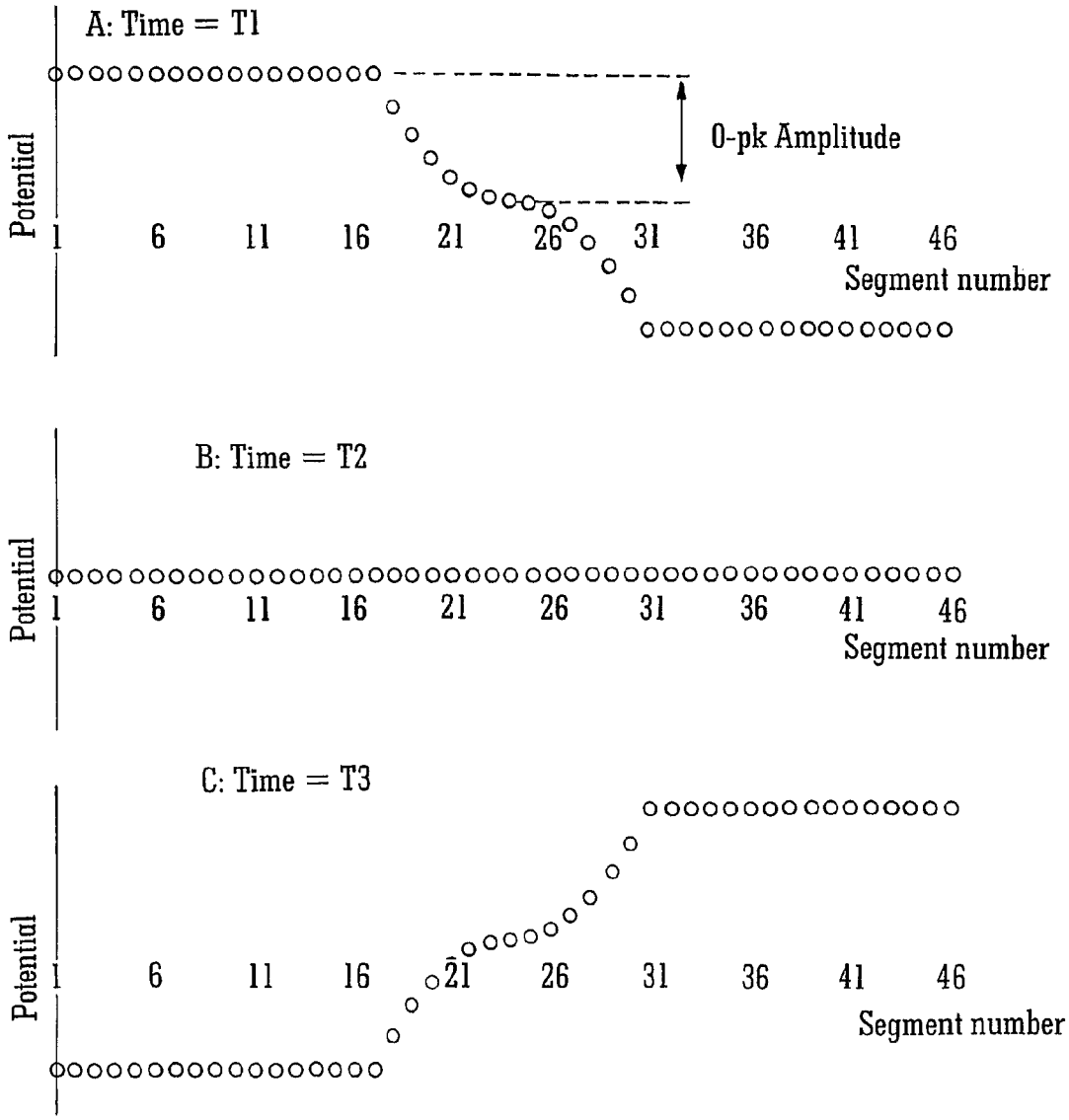
FIG. 14 shows the form of the modulated potential in the z-axis used to eject ions by a conventional method of resonance excitation.

FIG. 14 shows the form of the resonance excitation waveform used to resonantly eject ions from the ion trap at times T1, T2 and T3 as described for FIG. 10. The general form of the resonance excitation voltage is given by:

$$V(t) = \left(\frac{z}{|z|}\right)z^2\cos(\sigma t) \tag{51}$$

wherein z is the axial displacement from the centre of the electrostatic well shown in FIG. 2. The 0 to peak amplitude of the resonance excitation waveform was set to 2 Volts.

This waveform was chosen to emulate the conditions for dipole excitation in a Paul ion trap.

Figure 15:
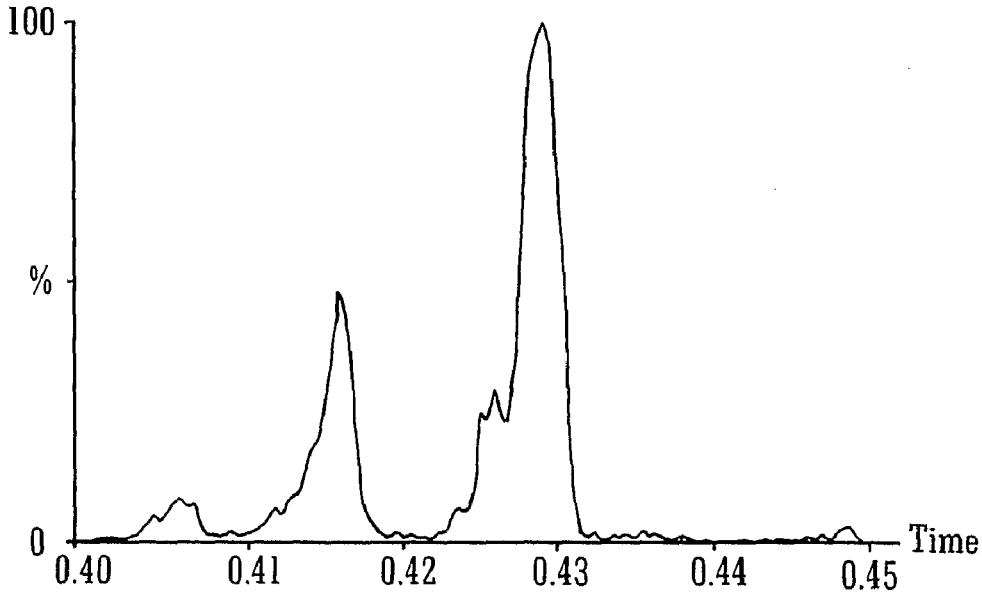
FIG. 15 shows a plot of the signal amplitude verses time as recorded by a photomultiplier ion detector when ions were ejected using a resonance excitation waveform as shown in FIG. 14 in accordance with a conventional method.

FIG. 15 shows the resulting signal recorded at the detector 26 as a function of time for the resonance excitation experiment described above.

Figure 16:
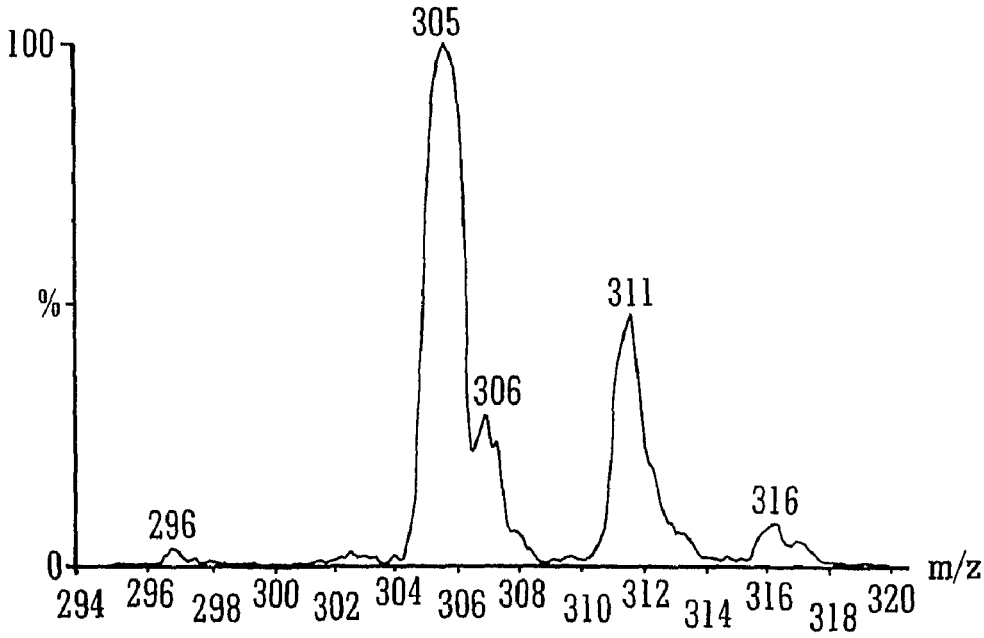
FIG. 16 shows the same data as shown in FIG. 15 after mass calibration.

FIG. 16 shows the same spectrum shown in FIG. 15 after mass calibration following the calibration law in Eqn. 50.

The frequency at which the ions were resonantly ejected from the ion trap 1 was approximately 13,000 Hz. The measured mass resolution was approximately 230 FWHM i.e. the mass resolution was considerably worse than the mass resolution obtained by the method of parametric excitation according to the preferred embodiment.

Other less preferred embodiments are contemplated wherein the ion guide or ion trap 1 may comprise a monopole, hexapole, octapole or higher order multi-pole ion guide or ion trap and wherein ions are radially confined within the ion guide or ion trap. Higher order multi-poles have a higher order pseudo-potential well function and the base of the pseudo-potential well is correspondingly broader so that the ion guide or ion trap has a higher capacity for charge thereby improving the overall dynamic range. In addition the higher order radial fields within non-quadrupolar devices reduce the likelihood of radial resonance losses. In non-linear radial fields the frequency of the radial secular motion is related to position of the ions. Therefore, ions will go out of resonance before they are ejected.

The ion trap may comprise segmented rod electrodes having either hyperbolic, circular or square cross sections. Rods having other shapes may also be used.

According to a less preferred embodiment an axial DC potential well may be formed by using continuous non-segmented rods. According to this embodiment the rods may be non-conducting and may be coated with a non-uniform resistive material. A voltage may be applied between the centre of the rods and the ends of the rods resulting in an axial potential well being formed within the ion trap.

According to another embodiment an axial electrostatic potential well may be formed by placing a segmented, resistively coated, or suitably shaped electrode around or adjacent the outside of a multi-pole rod set ion trap. Application of a suitable voltage to the electrode can result in the required electrostatic potential well within the ion confinement region of the ion guide or ion trap.

According to another embodiment the ion guide or ion trap may comprise a RF ring stack ion tunnel ion guide or ion trap comprising a plurality of electrodes. Each electrode preferably comprises a circular or non-circular aperture. An AC or RF voltage of alternating polarity is preferably applied to adjacent annular rings of the ion tunnel ion guide in order to create a radial pseudo-potential well which preferably acts to confine ions radially within the ion guide or ion trap. A DC voltage is preferably applied to the electrodes in order to create an electrostatic axial potential well. A supplemental AC voltage is also preferably applied to the electrodes in order to excite ions parametrically.

According to another embodiment the ion guide or ion trap may comprise two stacks of plates either side of the ion trajectory with opposite phases of an RF voltage being applied to adjacent plates. Plates top and bottom of two such stacks of plates may be used to effect a confined ion trapping volume. The confining plates may be segmented to allow an axial trapping electrostatic potential function to be superimposed and mass selective axial ejection may be performed using the methods described above.

Further embodiments are contemplated wherein multiple axial DC potential wells may be provided along the length of the ion guide or ion trap. By manipulating the superimposed DC voltage applied to the electrode segments, ions may be trapped in specific axial regions. Ions trapped within a DC potential well in a specific region of the ion trap may be subjected to mass selective ejection causing one or more ions to leave that potential well. The ions which are ejected may then subsequently be trapped in a separate axial potential well within the same ion trap. This type of operation may be utilised to study ion-ion interactions. In this mode of operation ions may be introduced from either or both ends of the ion trap substantially simultaneously.

Alternatively, ions trapped in a first axial potential well may be subjected to mass selective ejection conditions so that only ions having a specific mass to charge ratio or range of mass to charge ratios leave the first axial potential well and enter a second axial potential well. Mass selective excitation may be performed in the second axial potential well to fragment these ions. The resulting fragment or daughter ions may then preferably be ejected sequentially from this potential well for axial detection. Repeating this MS/MS process enables all the ions within the first axial potential well to be recorded with substantially 100% efficiency.

It is possible to arrange for more than two axial potential wells to be formed within the ion trap thereby enabling complex experiments to be performed. Alternatively, this flexibility may be used to condition the characteristics of ion packets for introduction to other analysis techniques.

The axial trapping electric field and the supplemental excitation electric field are both preferably substantially linear. However, other embodiments are contemplated wherein non-linear electric fields are used and hence non-linear resonance conditions are met.

Although the present invention has been described with reference to preferred embodiments, it will be understood by those skilled in the art that various changes in form and detail may be made without departing from the scope of the invention as set forth in the accompanying claims.

The invention claimed is:

1. An ion guide or ion trap comprising:

a plurality of electrodes;

an AC or RF voltage supply arranged and configured to apply an AC or RF voltage to at least some of said plurality of electrodes in order to confine at least some ions radially within said ion guide or ion trap;

first means arranged and adapted to maintain one or more DC, real or static potential wells along at least a portion of the axial length of said ion guide or ion trap in a first mode of operation; and second means arranged and adapted to apply a supplemental AC voltage or potential to said electrodes in order to excite parametrically at least some ions, in use, within said one or more potential wells, wherein said supplemental AC voltage or potential has a frequency $\sigma$ which excludes the fundamental frequency $\omega$ of the at least some ions which are excited parametrically;

wherein said ion trap or ion guide comprises a linear ion trap or ion guide; and wherein said second means is arranged and adapted to cause certain ions to be parametrically excited and axially ejected from said ion guide or ion trap.

2. An ion guide or ion trap as claimed in claim 1, wherein said supplemental AC voltage or potential has a frequency $\sigma$ equal to $2\omega$, $0.667\omega$, $0.5\omega$, $0.4\omega$, $0.33\omega$, $0.286\omega$, $0.25\omega$ or $<0.25\omega$ wherein $\omega$ is the fundamental or resonance frequency of ions which are desired to be excited parametrically.

3. An ion guide or ion trap as claimed in claim 1, wherein said first means is arranged and adapted to maintain one or more DC, real or static quadratic potential wells along at least a portion of the axial length of said ion guide or ion trap in said first mode of operation.

4. An ion guide or ion trap as claimed in claim 1, wherein said second means is arranged and adapted in said first mode of operation to generate an axial electric field which has a substantially linear electric field strength along at least a portion of the axial length of said ion guide or ion trap at any point in time.

5. An ion guide or ion trap as claimed in claim 1, wherein said second means is arranged and adapted in said first mode of operation to generate an axial electric field which has an electric field strength which varies with time.

6. An ion guide or ion trap as claimed in claim 1, wherein said second means is arranged and adapted in said first mode of operation to generate an axial electric field which changes direction with time.

7. An ion guide or ion trap as claimed in claim 1, further comprising means arranged and adapted to alter or vary or scan the amplitude of said supplemental AC voltage or potential.

8. An ion guide or ion trap as claimed in claim 1, further comprising means arranged and adapted to alter or vary or scan the frequency of oscillation or modulation of said supplemental AC voltage or potential.

9. An ion guide or ion trap as claimed in claim 1, further comprising means arranged and adapted to alter or vary or scan the amplitude or depth of said one or more DC, real or static potential wells.

10. An ion guide or ion trap as claimed in claim 1, comprising means arranged and adapted to mass selectively eject ions from said ion guide or ion trap.

11. An ion guide or ion trap as claimed in claim 1, wherein said ion guide or ion trap is segmented axially or comprises a plurality of axial segments.

12. An ion guide or ion trap as claimed in claim 1, wherein in a further mode of operation ions are trapped but are not substantially fragmented within said ion guide or ion trap.

13. An ion guide or ion trap as claimed in claim 1, wherein in a further mode of operation said ion guide or ion trap is arranged to mass filter or mass analyse ions.

14. A mass spectrometer comprising an ion guide or an ion trap as claimed in claim 1.

15. A mass spectrometer as claimed in claim 14, further comprising a mass filter or mass analyser arranged upstream or downstream of said ion guide or ion trap.

16. A mass spectrometer as claimed in claim 15, wherein in a further mode of operation said mass filter or mass analyser is scanned or a mass to charge ratio transmission window of said mass filter or mass analyser is varied with time in synchronism with the operation of said ion guide or ion trap or with the mass to charge ratio of ions emerging from or being transmitted to said ion guide or ion trap.

17. A method of guiding or trapping ions comprising:

providing a linear ion guide or ion trap comprising a plurality of electrodes;

applying an AC or RF voltage to at least some of said plurality of electrodes in order to confine at least some ions radially within said ion guide or ion trap;

maintaining one or more DC, real or static potential wells along at least a portion of the axial length of said ion guide or ion trap in a first mode of operation; and applying a supplemental AC voltage or potential to said electrodes in order to excite parametrically ions within said one or more potential wells, wherein said supplemental AC voltage or potential has a frequency $\sigma$ which excludes the fundamental frequency $\omega$ of ions within said ion guide or ion trap which are excited parametrically;

and wherein applying said supplemental AC voltage or potential causes certain ions to be parametrically excited and axially ejected from said ion guide or ion trap.

18. The method of claim 17, wherein applying said supplemental AC voltage or potential causes said certain ions to oscillate axially along a length of said ion guide or ion trap and then be axially ejected from said ion guide or ion trap.

19. The method of claim 18, further comprising oscillating said certain ions axially within said one or more potential wells before said certain ions are axially ejected from said ion guide or ion trap.

20. An ion guide or ion trap as claimed in claim 1, wherein said supplemental AC voltage or potential is arranged and adapted to cause said certain ions to oscillate axially along a length of said ion guide or ion trap and then be axially ejected from said ion guide or ion trap.

21. An ion guide or ion trap as claimed in claim 20, wherein said supplemental AC voltage or potential is arranged and adapted to cause said certain ions to oscillate axially within said one or more potential wells and then be axially ejected from said ion guide or ion trap.

22. An ion guide or an ion trap as claimed in claim 1, wherein said supplemental AC voltage or potential has a frequency $\sigma$ equal to $$\frac{2}{n},$$

wherein n is 1 or an integer greater than 2 and $\omega$ is the fundamental frequency of the at least some ions which are excited parametrically.

23. An ion guide or ion trap comprising:

a plurality of electrodes;

an AC or RF voltage supply arranged and configured to apply an AC or RF voltage to at least some of said plurality of electrodes in order to confine at least some ions radially within said ion guide or ion trap;

first means arranged and adapted to maintain one or more DC, real or static potential wells along at least a portion of the axial length of said ion guide or ion trap in a first mode of operation; and second means arranged and adapted to apply only a supplemental AC voltage or potential to said electrodes in order to excite parametrically at least some ions, in use, within said one or more potential wells, wherein said supplemental AC voltage or potential has a frequency $\sigma$ equal to $$\frac{2}{n},$$

wherein n is 1 or an integer greater than 2 and $\omega$ is the fundamental frequency of the at least some ions which are excited parametrically;

wherein said ion trap or ion guide comprises a linear ion trap or ion guide; and wherein said second means is arranged and adapted to cause certain ions to be parametrically excited and axially ejected from said ion guide or ion trap.

24. A method of guiding or trapping ions comprising:

providing a linear ion guide or ion trap comprising a plurality of electrodes;

applying an AC or RF voltage to at least some of said plurality of electrodes in order to confine at least some ions radially within said ion guide or ion trap;

maintaining one or more DC, real or static potential wells along at least a portion of the axial length of said ion guide or ion trap in a first mode of operation; and applying only a supplemental AC voltage or potential to said electrodes in order to excite parametrically ions within said one or more potential wells, wherein said supplemental AC voltage or potential has a frequency $\sigma$ equal to $$\frac{2}{n},$$

wherein n is 1 or an integer greater than 2 and $\omega$ is the fundamental or resonant frequency of the ions which are excited parametrically;

and wherein applying said supplemental AC voltage or potential causes certain ions to be parametrically excited and axially ejected from said ion guide or ion trap.

* * * * *